US011771946B2

(12) United States Patent
Ix et al.

(10) Patent No.: US 11,771,946 B2
(45) Date of Patent: Oct. 3, 2023

(54) PHYSICAL FITNESS HAND GRIP FOR DYNAMIC RESISTANCE EXERCISES

(71) Applicant: Fitnix LLC., Darien, CT (US)

(72) Inventors: Christopher Ix, Darien, CT (US); Jose Chavarria, Arcata, CA (US); Tony Ward, San Po Kong (HK)

(73) Assignee: FITNIX LLC, Darien, CT (US)

( * ) Notice: Subject to any disclaimer, the term of this patent is extended or adjusted under 35 U.S.C. 154(b) by 375 days.

(21) Appl. No.: 17/120,649

(22) Filed: Dec. 14, 2020

(65) Prior Publication Data

US 2021/0178217 A1 Jun. 17, 2021

Related U.S. Application Data

(60) Provisional application No. 62/948,177, filed on Dec. 13, 2019.

(51) Int. Cl.
*A63B 24/00* (2006.01)
*A63B 21/00* (2006.01)

(52) U.S. Cl.
CPC ..... *A63B 21/4035* (2015.10); *A63B 24/0062* (2013.01); *A63B 2220/17* (2013.01); *A63B 2220/51* (2013.01); *A63B 2220/62* (2013.01); *A63B 2225/50* (2013.01); *A63B 2225/685* (2013.01)

(58) Field of Classification Search
CPC ... A63B 5/20; A63B 21/0722; A63B 21/0726; A63B 21/169; A63B 21/4035; A63B 22/1236; A63B 24/0062; A63B 2071/0658; A63B 2071/068; A63B 2220/17; A63B 2220/40; A63B 2220/51; A63B 2220/62; A63B 2225/20; A63B 2225/50; A63B 2225/685
See application file for complete search history.

(56) References Cited

U.S. PATENT DOCUMENTS

| | | | | |
|---|---|---|---|---|
| 5,632,707 | A * | 5/1997 | Daniel | A63B 22/20 482/141 |
| 8,475,343 | B2 * | 7/2013 | Hinds | A63B 23/12 482/141 |
| 10,099,083 | B1 * | 10/2018 | Owusu | A63B 24/0062 |
| 10,463,906 | B2 * | 11/2019 | Owusu | A63B 24/0087 |
| 10,786,700 | B2 * | 9/2020 | Owusu | A63B 24/0087 |
| 10,843,028 | B2 * | 11/2020 | Nalley | A63B 21/0604 |
| 2002/0128127 | A1 * | 9/2002 | Chen | A63B 21/0726 482/106 |

(Continued)

*Primary Examiner* — Joshua Lee
(74) *Attorney, Agent, or Firm* — Hodgson Russ LLP

(57) ABSTRACT

A fitness tool is described. The tool includes a grip component and a handle component. The handle component includes sensors and the grip component includes an electronics unit. The electronics unit includes a fitness application. The fitness application receives a signal from a button located on the grip component to signal that the user is performing an exercise. The fitness application also receives a measurement of force applied to the handle component from the sensors. The fitness application processes the signal and the measurement of force and then transmits the signal, the measurement of force, and other exercise metrics to a computing device. The user interacts with another application on the computing device to view, track, and modify these exercise metrics.

20 Claims, 32 Drawing Sheets

(56) References Cited

U.S. PATENT DOCUMENTS

| | | | | |
|---|---|---|---|---|
| 2006/0040809 | A1* | 2/2006 | Godbold | A63B 23/14 482/141 |
| 2010/0113225 | A1* | 5/2010 | Mills | A63B 21/4019 482/141 |
| 2015/0367163 | A1* | 12/2015 | Moran | A63B 71/0036 482/108 |
| 2016/0059064 | A1* | 3/2016 | Smith | A63B 24/0062 482/5 |
| 2019/0240526 | A1* | 8/2019 | Owusu | A63B 21/0724 |
| 2020/0078632 | A1* | 3/2020 | Owusu | A63B 21/4035 |
| 2021/0077848 | A1* | 3/2021 | Owusu | A63B 21/4035 |

* cited by examiner

PHYSICAL FITNESS HAND GRIP FOR DYNAMIC RESISTANCE EXERCISES

CROSS-REFERENCE TO RELATED APPLICATIONS

This application is a U.S. Non-Provisional patent application that claims priority to U.S. Provisional Patent Application No. 62/948,177, filed on Dec. 13, 2019, the contents of which are hereby fully incorporated by reference.

FIELD OF THE EMBODIMENTS

Embodiments generally relate to physical fitness equipment, and in particular, to a hand grip for performing dynamic resistance and isometric exercises.

BACKGROUND OF THE EMBODIMENTS

Recent years have seen major developments in electronics and gadgets for improving personal fitness and health, with countless smart watches and other portable fitness tracking software products offered on the market. These technologies are mostly focused on guiding users through workout routines and tracking progress by allowing users to record the exercises performed and performance of such exercises, including the number of repetitions, an exercise time, a quantity of calories burned, etc. Smart watches with sensors, such as Fitbit's step counter, have further improved these goals, allowing precise measurements and tracking of calories burnt and time spent exercising.

Despite the advancements in fitness technology, some people still face fundamental difficulties in keeping up with fitness regimens. Gyms are often crowded and inconvenient. Moreover, gyms are filled with germs and are often closed during bad weather events, natural disasters, and pandemics, such as COVID-19. In-home equipment can be expensive, heavy, dangerous, and can require a large amount of space at home. Furthermore, many exercise products cater towards either cardio or physical strength training for specific areas of the body, which increase the amount of exercise equipment required. Furthermore, working out without equipment (e.g., doing body weight exercises) may not provide an optimal workout experience, and may make it difficult to precisely measure achievements and performance. Additionally, most exercise equipment only focuses on a specific part of the body and does not allow a user to exercise upper and lower body simultaneously.

Thus, what is needed is an improved physical fitness hand grip for dynamic resistance exercises, isometric exercises, body weight resistance exercises, dumbbell weight resistance exercises, strap resistance exercises, band resistance exercises, jump rope exercises, and double workout advantage exercises. Moreover, what is needed is an improved physical fitness hand grip that provides a large amount of exercise data and metrics for the user.

SUMMARY OF THE EMBODIMENTS

The present invention and its embodiments relate to physical fitness equipment, and in particular, to a hand grip for performing dynamic resistance exercises, isometric exercises, body weight resistance exercises, dumbbell weight resistance exercises, strap resistance exercises, band resistance exercises, jump rope exercises, and double workout advantage exercises.

A first embodiment of the present invention describes a fitness tool. The fitness tool includes a grip component and a handle component. The grip component includes a planar portion, a first component, a second component, and an electronics unit. The planar portion has a side disposed opposite a second side. The first side of the planar portion includes a display and a first attachment component configured to receive and affix a first attachment thereto. In some examples, the first attachment is a smartphone.

The second side of the planar portion comprises a second attachment component configured to receive and affix a second attachment thereto. The second attachment may be another grip, a weight, a dumbbell, or a resistance band, among other examples. Moreover, in examples, the planar portion of the grip component further comprises a receiving portion. The receiving portion receives a protruding portion of a second attachment therein. In some examples, the second attachment is a flexible gooseneck affixed to a display. In other examples, the display is a smartphone display.

The gooseneck extension of the smartphone allows for the user to optimally see the smartphone in various exercise positions. When engaging with a fitness application during exercise, users typically need to prop the smartphone up against something on the floor, making it far away from the user. The user often wastes valuable time putting the smartphone down and picking it back up again while exercising.

The first component is affixed to a first location on the first side of the planar portion and extends away from the first side of the planar portion. Further, the second component is affixed to a second location on the first side of the planar portion and extends away from the first side of the planar portion. The first location is disposed opposite the second location. Moreover, one or more buttons are located on the handle component and/or the planar component. When a user executes a first button of the one or more buttons, a signal is transmitted to the electronics unit to count a number of repetitions. When a user executes a second button of the one or more buttons, a signal is transmitted to the electronics unit to progress to a next exercise. When a user executes a third button of the one or more buttons, a signal is transmitted to the electronics unit to progress to a next set. It should be appreciated that the quantity of the one or more buttons is not limited to any particular quantity. Moreover, the one or more buttons may be used for other purposes, as described herein.

The handle component is disposed between the first component and the second component. The handle component is perpendicular to the first side of the planar portion of the grip component. Moreover, the handle component includes one or more sensors. The one or more sensors are configured to measure a force applied to the handle component and transmit the measurement of the force to the electronics unit.

The electronics unit includes a processor, a memory, a fitness application, and/or an accelerometer. The accelerometer is configured to measure motion for automatic repetition count and automatically determine a type of exercise being performed by the user. Moreover, in examples, the accelerometer measures movement approximately 10 times per second. The fitness application of the electronics unit is configured to: process and maintain data associated with exercise metrics of a user and transmit the data associated with the exercise metric of the user to a computing device via WiFi, Bluetooth, or Bluetooth Low Energy, as will be discussed further herein.

A second embodiment of the present invention describes a method using a fitness tool to process and maintain data associated with exercise metrics of a user. The fitness tool includes a grip component affixed to a handle component. The grip component comprises an electronics unit and the handle component comprises one or more sensors. The method includes numerous process steps, such as: receiving, by a fitness application of the electronics unit, a signal from a button located on the grip component to signal that the user is performing an exercise. Next, the method includes: receiving, by the fitness application, a measurement of force applied to the handle component from the one or more sensors. The method further includes: processing, by the fitness application, the signal and the measurement of force. The method also includes: transmitting, by the fitness application, the signal, the measurement of force, and other exercise metrics to a computing device via WiFi, Bluetooth, or Bluetooth Low Energy.

The computing device includes a processor, a memory coupled to the processor, a graphical user interface (GUI), and the fitness application. The user is configured to interface with the fitness application of the computing device via the GUI to: create a user profile, select a workout category, select a workout within the workout category, view details of the workout, modify a parameter (e.g., a warm-up stretch, a cool-down stretch, an alternative exercise, a countdown timer, and/or a choice of movement, where the choice of movement includes sitting, standing, hiking, jogging, and/or running) within the selected workout, select an activity type for the workout (e.g., body weight resistance (such as ab resistance), self-resistance, strap resistance (e.g., boxing and band resistance), dumbbell, heavy jump rope, warm-up stretch, warm-up jogging drills, and/or cool-down stretch, among others), select a muscle group for the workout (e.g., chest, triceps, upper back, lower back, biceps, forearms, shoulders, traps, abs, obliques, quads, hamstrings, hips, and/or glutes, among others), select a difficulty level associated with the workout, view a workout history, view graphical depictions of the workout history, filter the workout history by date, filter the workout history by weight balance, and/or modify a grouping of workouts into a daily sequence unique to the user, among other actions that will be described herein.

The workouts may be divided based on category, degree of difficulty, muscle group focus, and/or duration. Further, the details of the workout include: an exercise name, an exercise order, a number of repetitions, a number of sets, a circuit identifier, an estimated time for completion of each interval, a video demonstrating how to perform a repetition, a textual explanation of how to perform the repetition, and/or a graphical explanation of how to perform the repetition, among others. The user may further interact with the fitness application of the computing device as described herein.

DESCRIPTION OF THE PREFERRED EMBODIMENTS

Figure 1A:
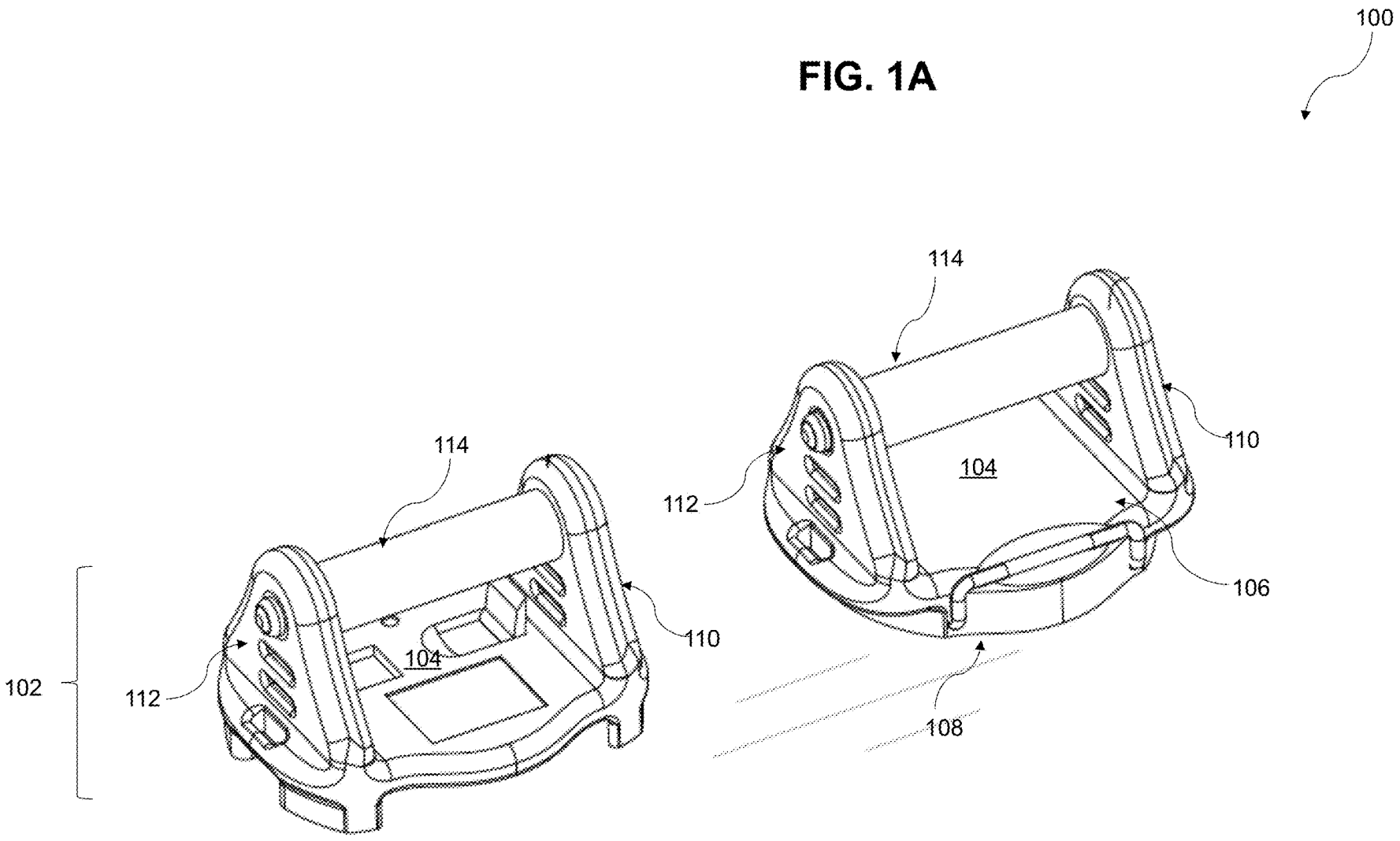
FIG. 1A depicts a perspective view of a first grip and a second grip of a physical fitness grip tool, according to at least some embodiments described herein.
Figure 1B:
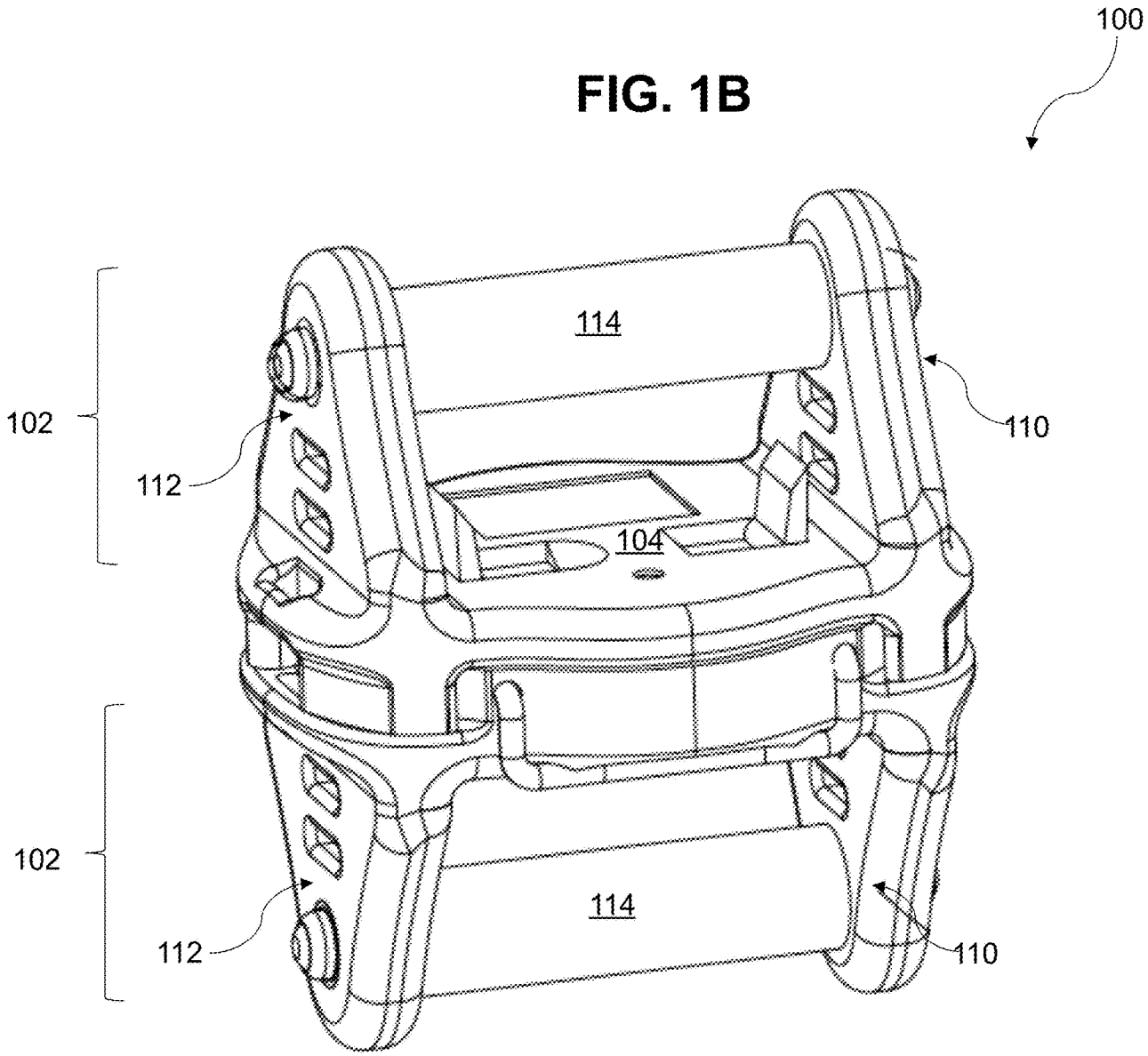
FIG. 1B and FIG. 1C depict perspective views of a first grip affixed to a second grip of a physical fitness grip tool, according to at least some embodiments described herein.
Figure 1C:
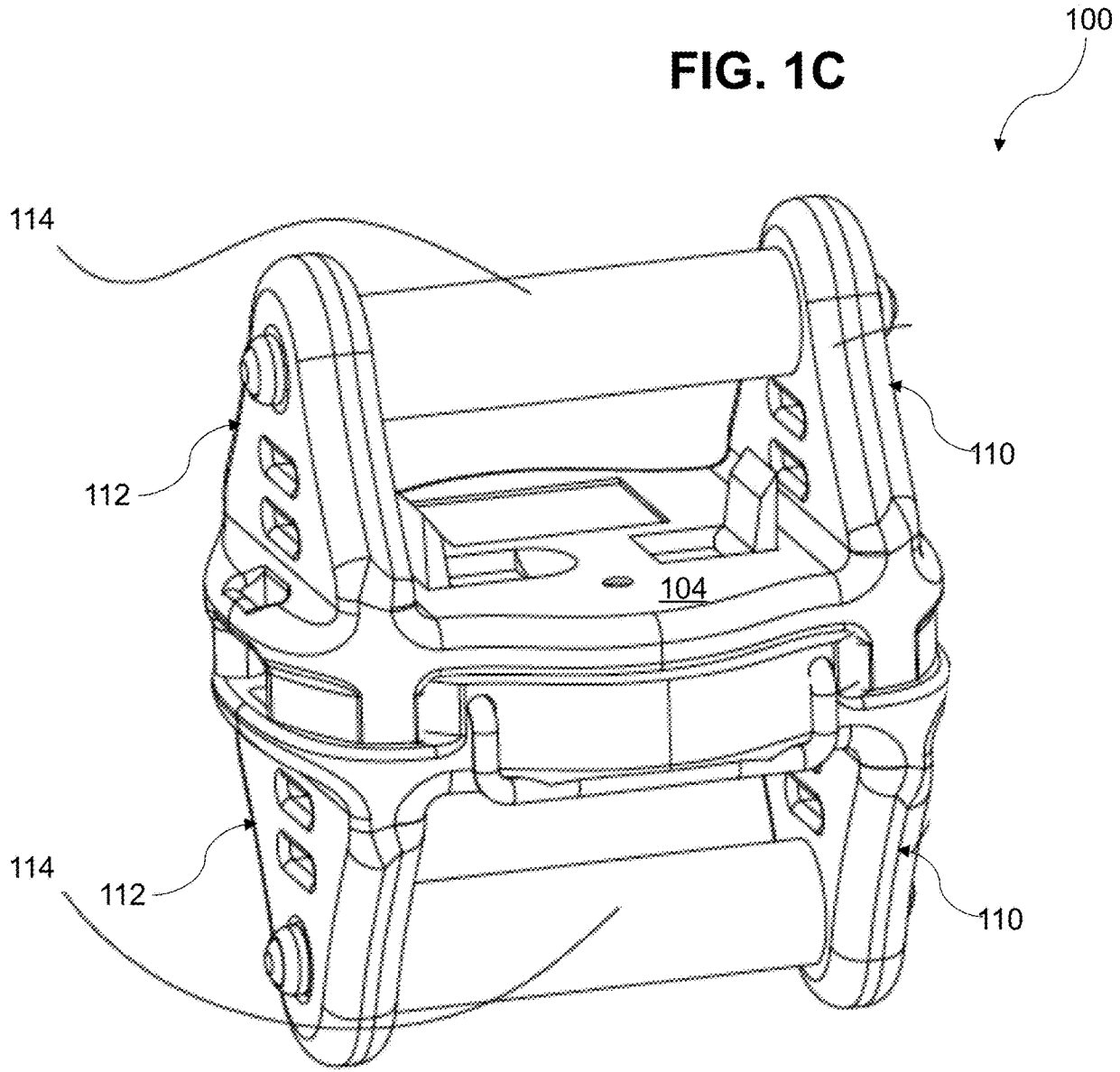

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Provided herein are embodiments for a physical fitness grip tool 100 for dynamic resistance and isometric exercises with a weight and repetition counter. The physical fitness grip tool 100 is highly portable and allows users to perform a wide variety of exercises without the need for spacious equipment. The physical fitness grip tool 100 also allows users to measure their workout performance and results for both cardio and physical strength exercise that permits a complete body workout. Such workout includes 235 exercises and stretches with over a 1,000 different exercise combinations since there are numerous ways one can combine specific lower and upper body exercises together. For example, there are many leg exercises that can be combined with over 20 types of self-resistance exercises.

The physical fitness grip tool 100 is described and depicted herein. Specifically, the physical fitness grip tool 100 includes a grip component 102 and a handle component 114 (as shown in at least FIG. 1A, FIG. 1B, FIG. 1C, FIG. 2A, FIG. 3, FIG. 19, FIG. 20, FIG. 21, FIG. 22, FIG. 23, FIG. 24, FIG. 26, and FIG. 27). It should be appreciated that the handle component 114 is removable and interchangeable with another handle component 114. The handle component 114 may be affixed to the physical fitness grip tool 100 with one or more fixation means, such as a bolt 130 (as shown in FIG. 3). The grip component 102 includes a planar portion 104, a first component 110, a second component 112, and an electronics unit 150 (of FIG. 27).

The first component 110 of the physical fitness grip tool 100 is affixed to a first location on the first side 106 of the planar portion 104 of the grip component 102 and extends away from the first side 106 of the planar portion 104. Further, the second component 112 is affixed to a second location on the first side 106 of the planar portion 104 of the grip component 102 and extends away from the first side 106 of the planar portion 104. The first location is disposed opposite the second location.

Figure 7:
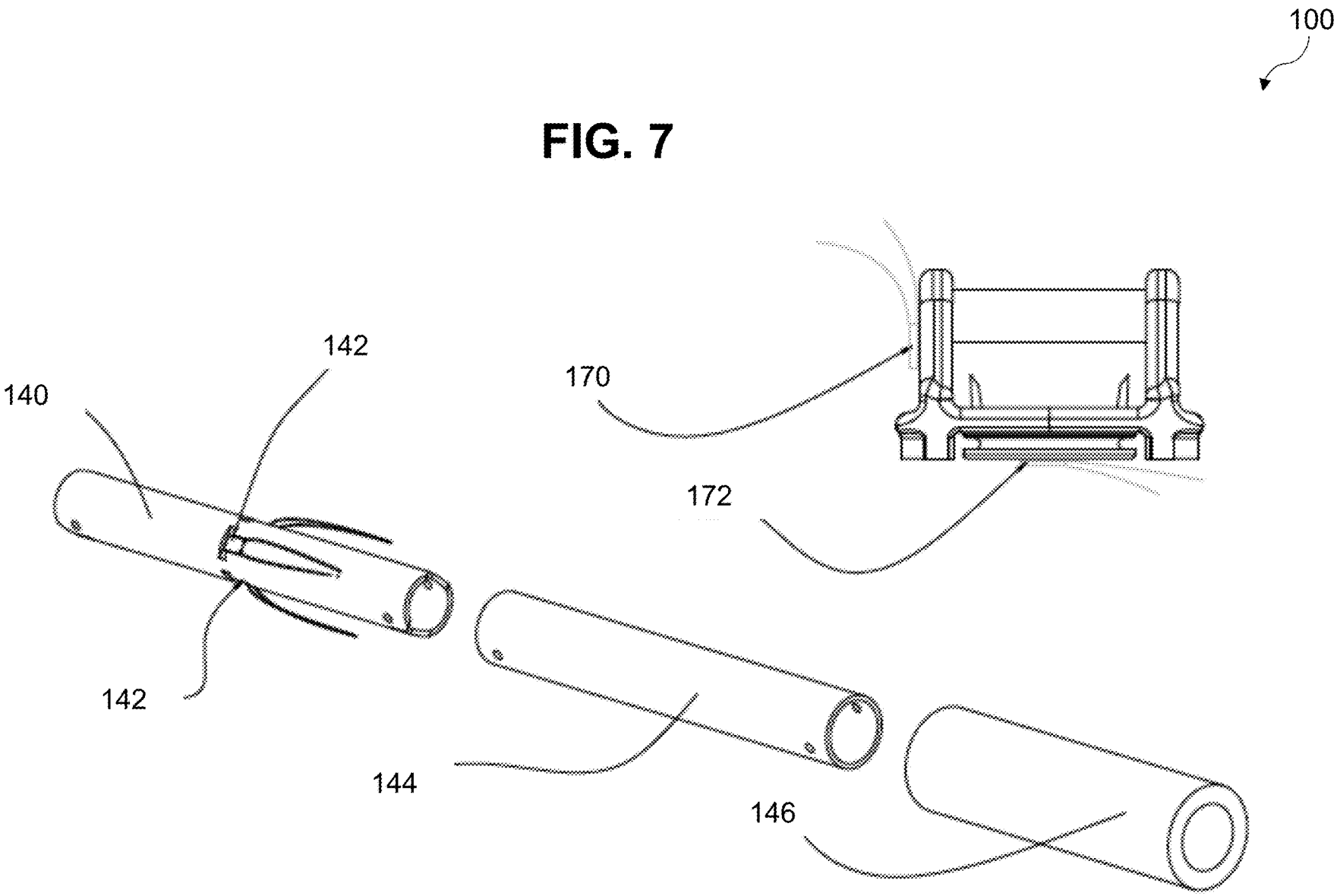
FIG. 7 depicts exploded views of a handle component of a physical fitness grip tool, according to at least some embodiments described herein.

The structure of the handle component 114 is depicted in FIG. 7. The handle component 114 comprises an inner handle component 140, a protective external tube 144, and a grip covering tube 146. The handle component 114, the protective external tube 144, inner handle component 140, and the grip covering tube 146 may comprise any suitable material, such as plastics, metals, etc. that would allow the handle 114 to yield to force and slightly bend. The inner handle component 140 includes one or more sensors 142. The one or more sensors 142 may be any suitable sensors capable of measuring force.

Figure 27:
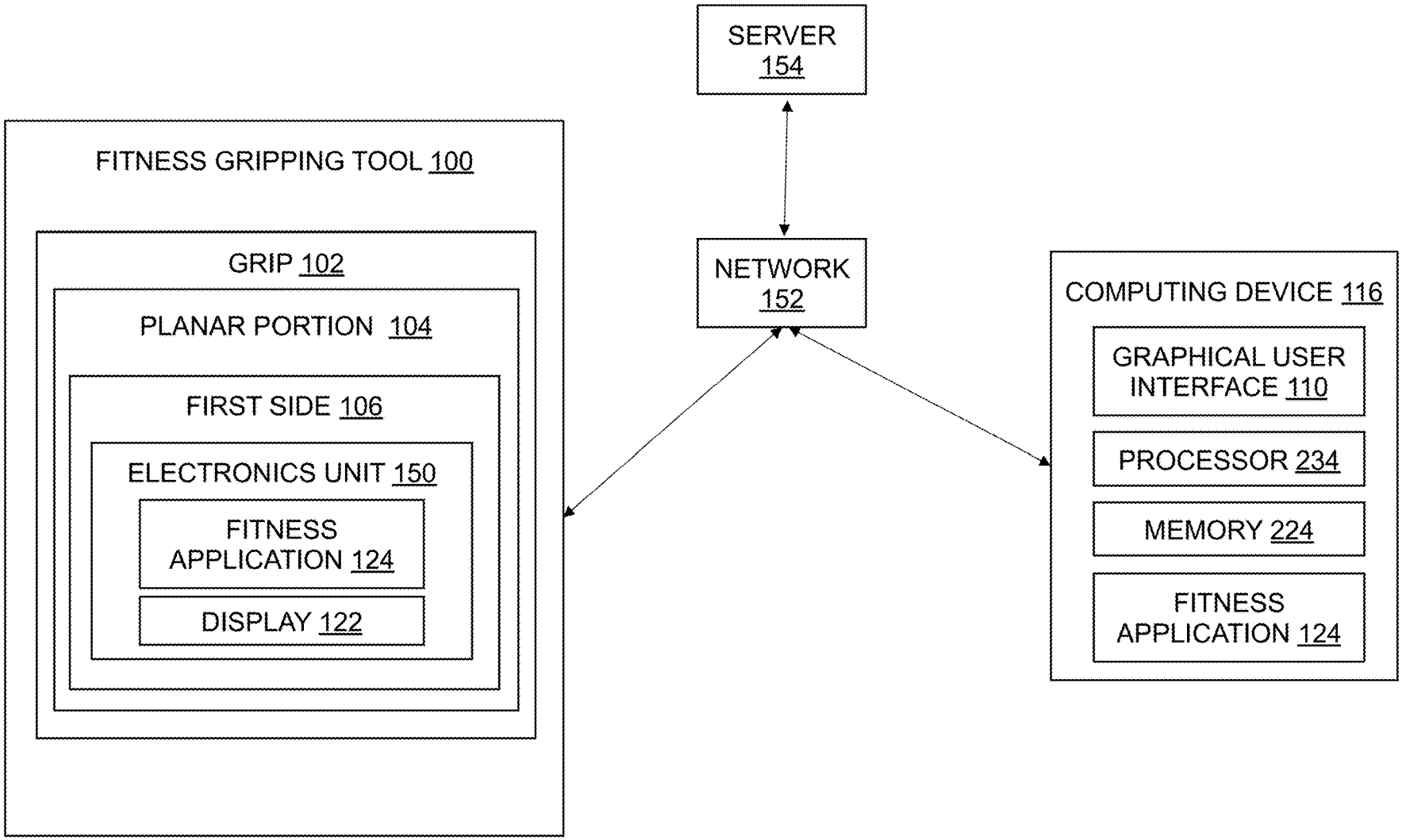
FIG. 27 depicts a system diagram, according to at least some embodiments described herein.

In particular embodiments, the one or more sensors 142 are strain gauges whose electrical resistance varies with applied force. It should be appreciated that strain gauges are just one example and any element/component may be used that measures force. The electronics unit 150 of FIG. 27 is configured to receive an electric current that travels through the strain gauges (e.g., the one or more sensors 142). In this manner, as a user grasps and pushes/pulls on the handle 114, the strain gauges (e.g., the one or more sensors 142) cause an electrical signal to be generated that can be measured by the electronics unit 150 to determine the amount of force being applied. By positioning a plurality of strain gauges (e.g., the one or more sensors 142) around the circumference of the handle 114, the direction of the applied forces can also be determined and recorded. Strain gauges (e.g., the one or more sensors 142) are used to measure the bend and determine the amount of force applied by the exercise repetition. Element 170 of FIG. 7 illustrates that the strain gauges (e.g., the one or more sensors 142) may be positioned to measure forces in the axis moving across the length of the physical fitness grip tool 100. An element 172 illustrates that strain gauges (e.g., the one or more sensors 142) may be positioned to measure forces applied straight down directly to the bottom disc, for example, when face plate pushups are performed without using the handle 114.

Further, as shown in FIG. 1A, the planar portion 104 of the physical fitness grip tool 100 has a first side 106 disposed opposite a second side 108. The first side 106 of the planar portion 104 includes a display 122 (of FIG. 3, FIG. 19, and FIG. 27) and a first attachment component 160 (of FIG. 3) configured to receive and affix a first attachment thereto.

Figure 5:
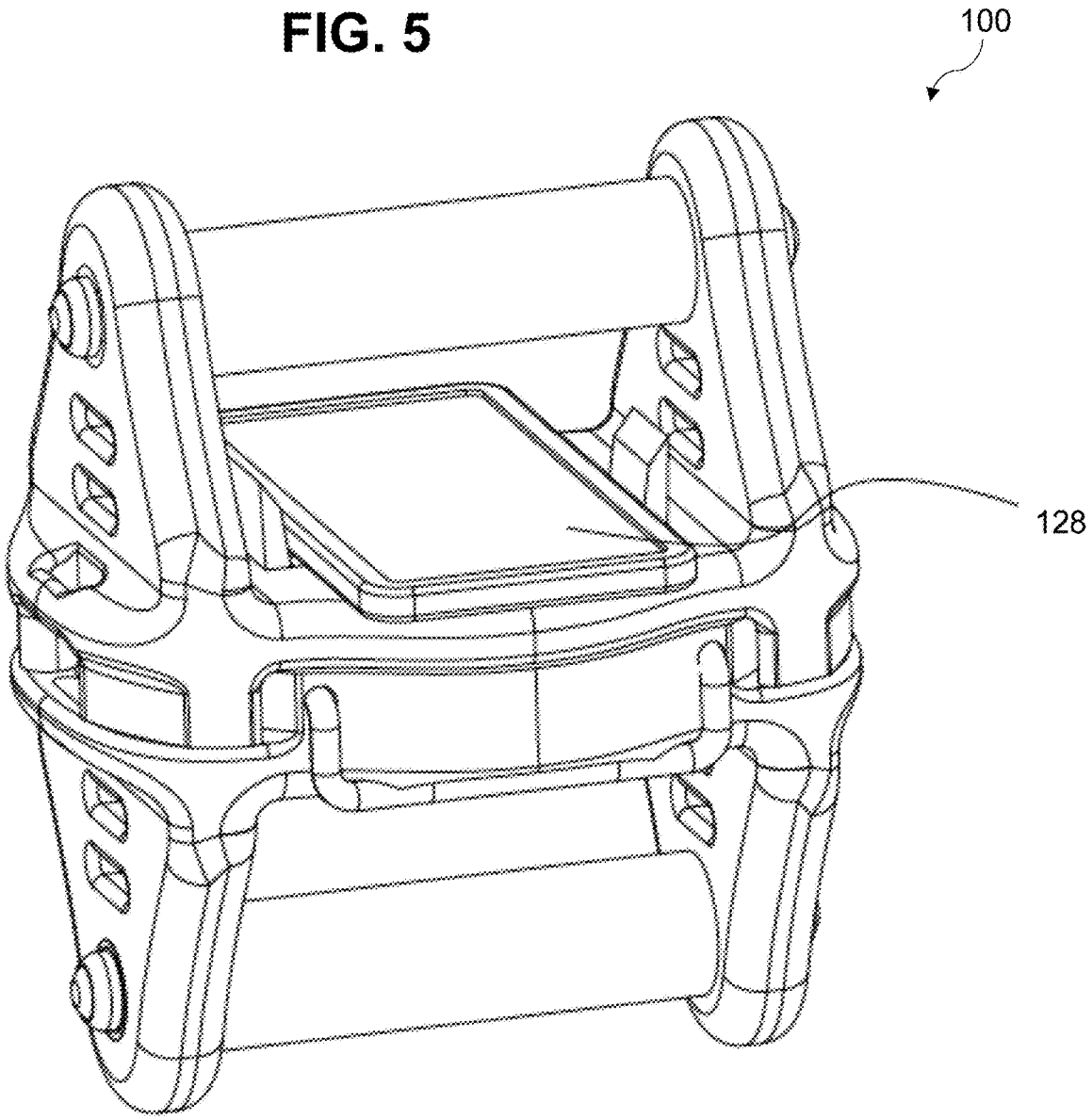
FIG. 5 depicts a perspective view of a smartphone affixed to a grip of a physical fitness grip tool, according to at least some embodiments described herein.
Figure 12:
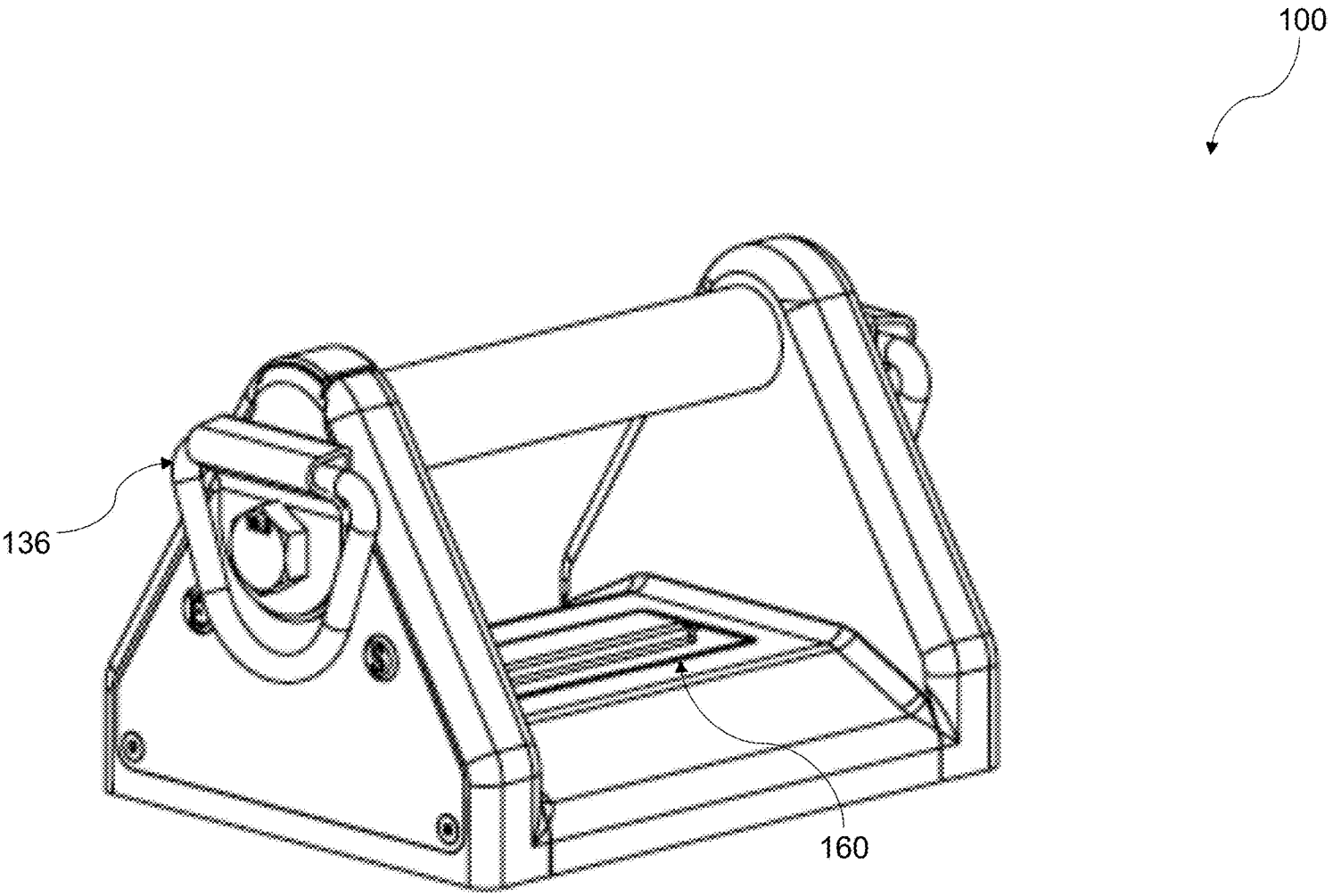
FIG. 12 and FIG. 13 depict perspective views of a grip of a physical fitness grip tool, according to at least some embodiments described herein.
Figure 13:
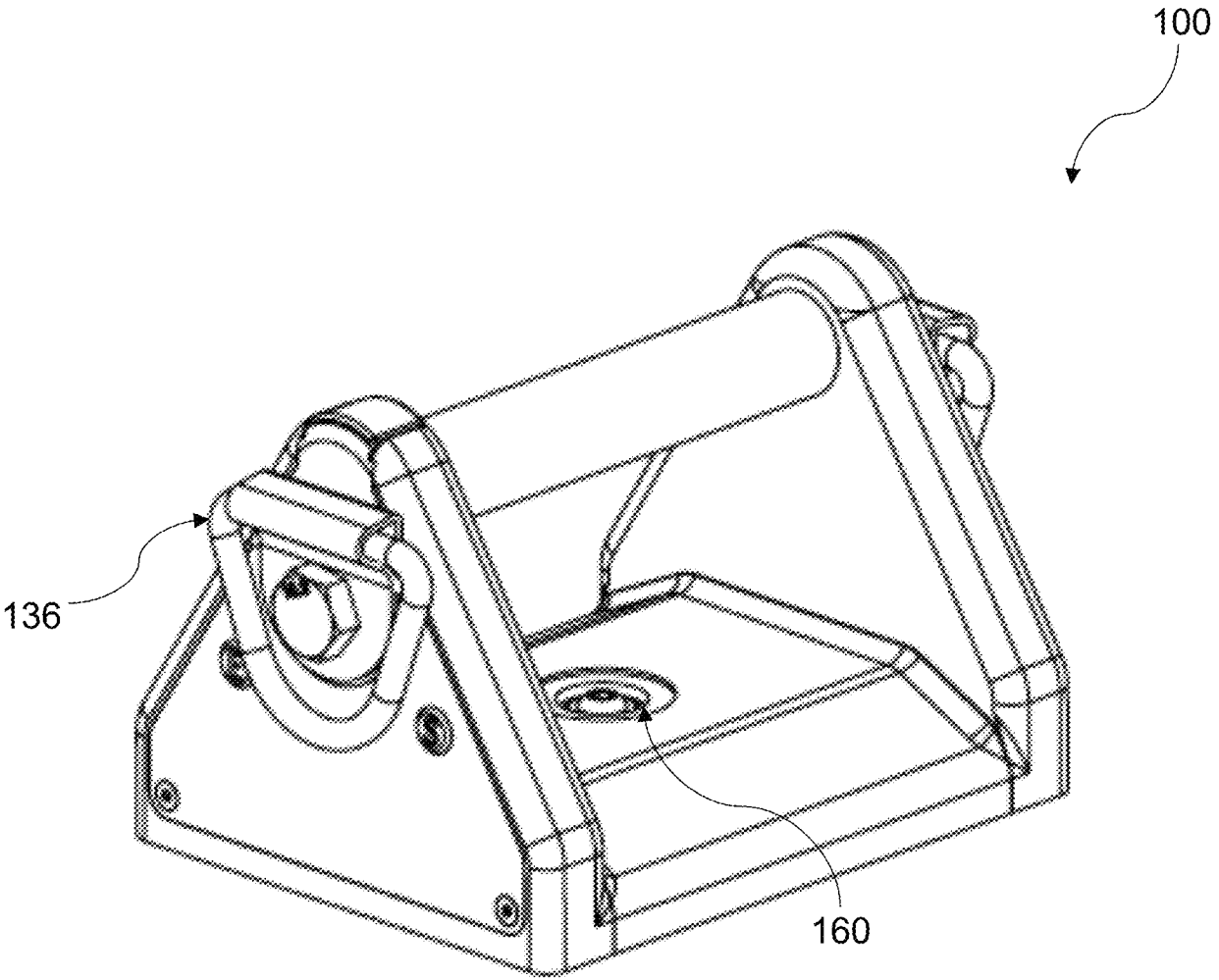

As an illustrative example, the first attachment component 160 may take any form, such as a flipper attachment (as shown in FIG. 3) that may extend and contract towards the first side 106 of the planar portion 104 to secure the first attachment. In another illustrative example, and as shown in FIG. 3, the first side 106 of the planar portion 104 may include external mounting bolt cavity 126 for securing an external device. It should be appreciated that the first attachment component 160 may comprise any attachment means and the examples described herein are for illustrative purposes only. Other example attachment components 160 are depicted in FIG. 12 and FIG. 13. If the button or the attachment component 160 is pressed, this permits for the easy, quick, and safe release of the quick connect feature. In some examples, the first attachment is a smartphone 128, as shown in FIG. 5. The display 122 and/or the smartphone 128 may display exercise metrics to the user, such as, but not limited to the repetition count for an exercise session, a total amount of weight lifted, etc., which will be discussed further herein.

Figure 2A:
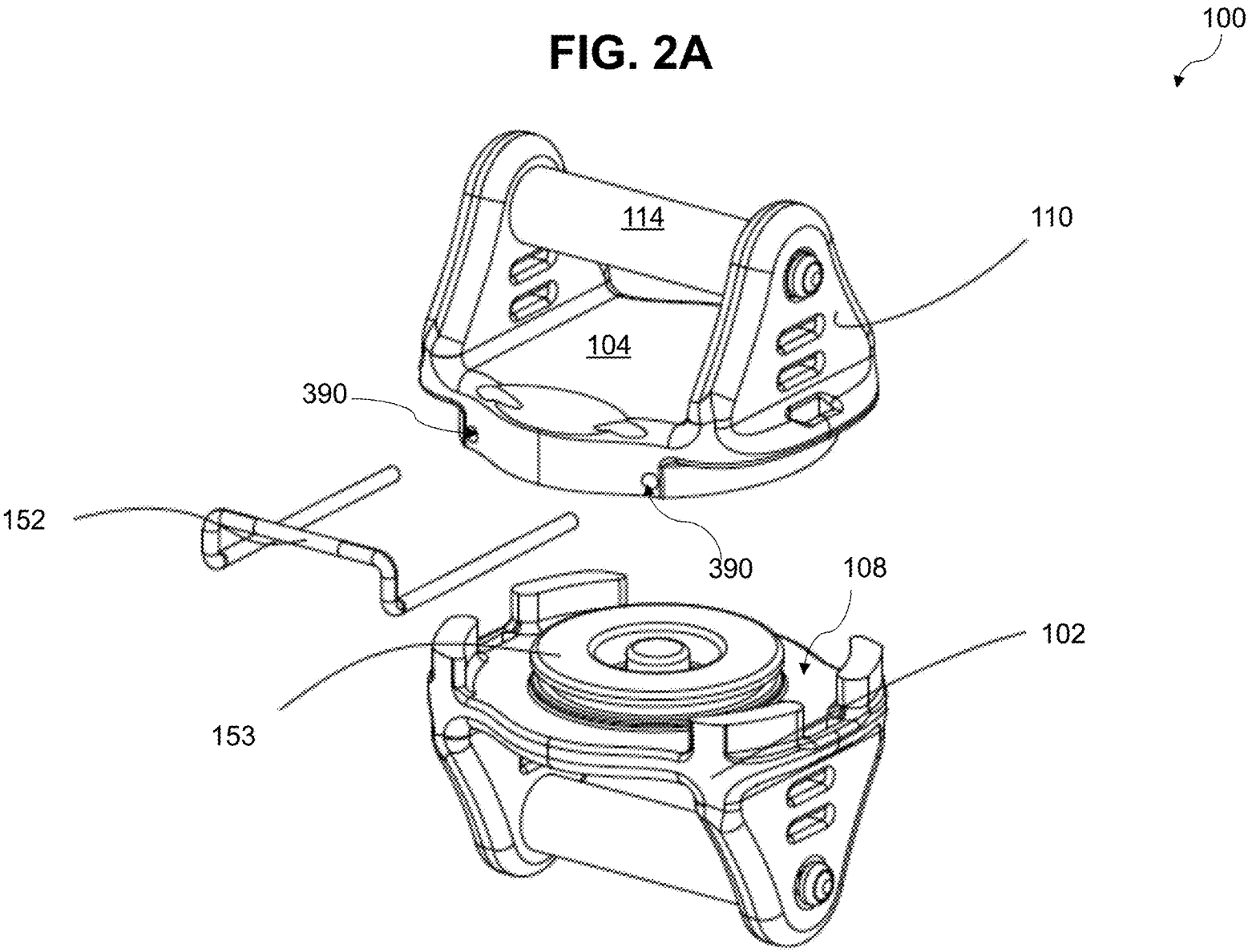
FIG. 2A depicts a perspective view of an attachment means to affix a first grip to a second grip of a physical fitness grip tool, according to at least some embodiments described herein.
Figure 2B:
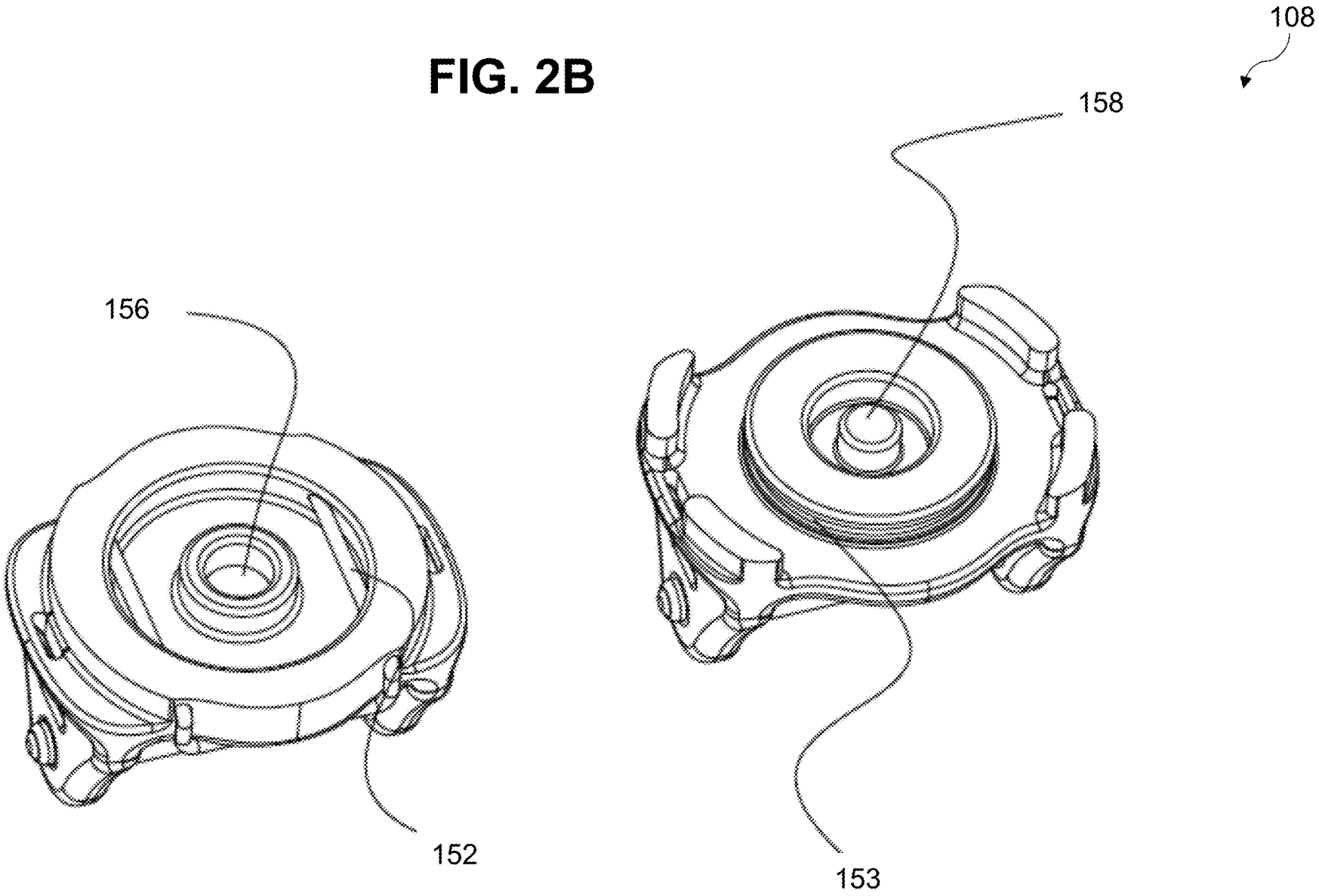
FIG. 2B depicts a perspective view of an attachment means of a physical fitness grip tool, according to at least some embodiments described herein.
Figure 3:
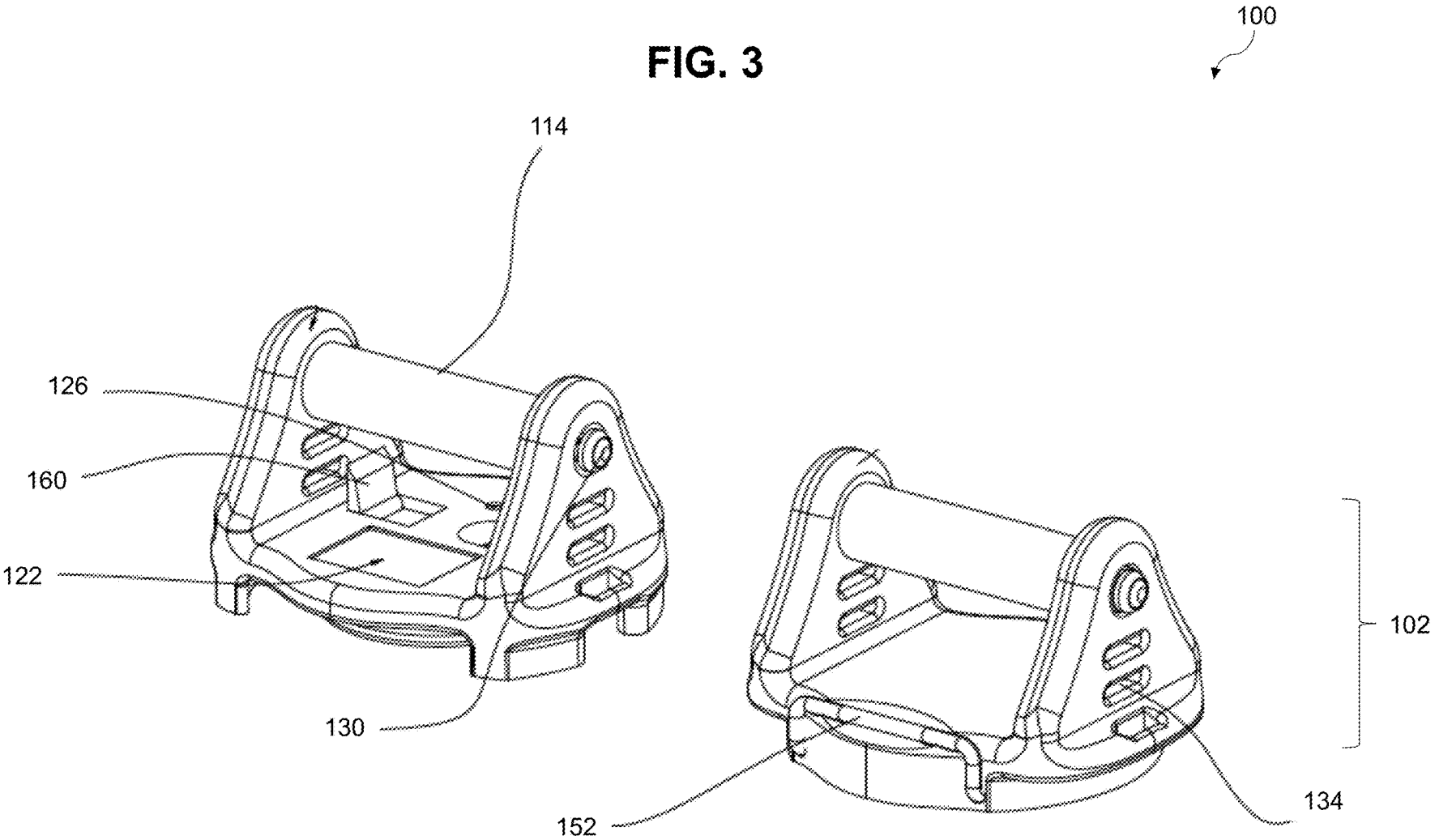
FIG. 3 depicts a perspective view of a first grip and a second grip of a physical fitness grip tool, according to at least some embodiments described herein.

The second side 108 of the planar portion 104 of the grip component 102 comprises a second attachment component 153 (as shown in FIG. 2A and FIG. 2B) configured to receive and affix a second attachment thereto. The second attachment may be another grip, a weight, a custom weight, a dumbbell, a fitness band, straps, or a jump rope, among other examples. However, since the grip weighs approximately 1 to 2 pounds, it can be used as a light dumbbell without the attachment of any weights.

In another example, and as shown in FIG. 2B, the second side 108 of the planar portion 104 of the grip component 102 of a first grip (e.g., of a first physical fitness grip tool) comprises a female end datum 156 configured to receive a male end datum 158 of the second side 108 of the planar portion 104 of the grip component 102 of a second grip (e.g., of a second physical fitness grip tool), thus allowing a user to easily align the grip surfaces properly for attachment. This configuration of the removable bail 152 and the cylindrical groove 153 allows both handles 114 to rotate along the axis perpendicular to their length while either attached to each other or separated. This allows for fluid range of motion during self-resistance exercises that provides greater comfort and range of motion and reduces the chance for injuries.

Figure 8:
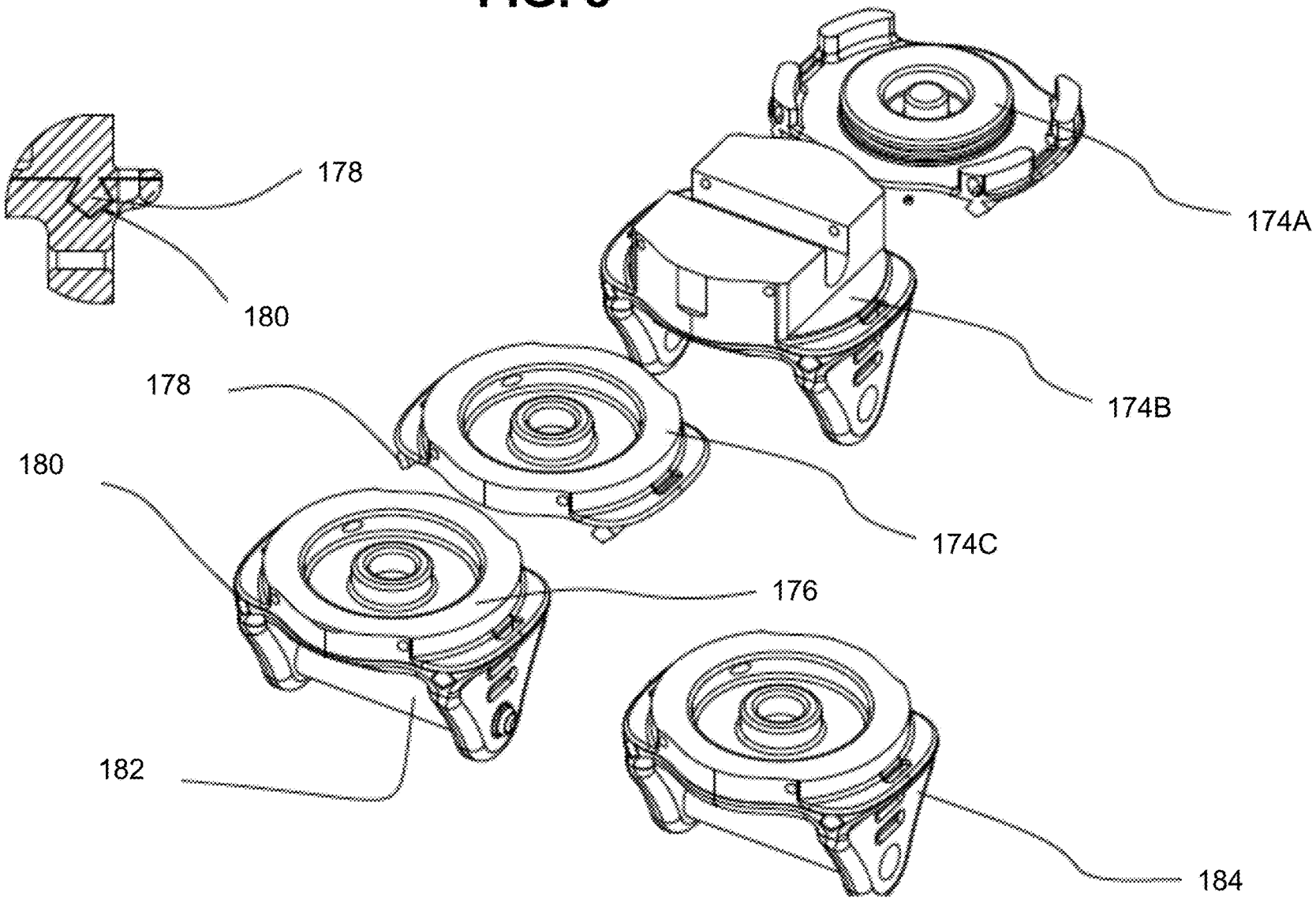
FIG. 8 depicts perspective view of an attachment means of a physical fitness grip tool, according to at least some embodiments described herein.

It should be appreciated that multiple means of attachment (e.g., the second attachment component 153) may be used. As shown in FIG. 8, the physical fitness grip tool 100 is designed to receive interchangeable attachments. In an example, the physical fitness grip tool 100 may have grooves 178, 180 designed to receive attachments 174A, 174B, 174C, which have corresponding ridges that snugly slide into the grooves 178, 180. The attachment 174A and the attachment 174C are configured to attach to each other using a removable bail, as described herein. The attachment 174A and the attachment 174C may be removed and replaced with the attachment 174B for receiving the dumbbell 164, as described and depicted in FIG. 6A and FIG. 6B. A element 184 shows a grip 182 coupled with the attachment 174C, as a result of sliding the attachment from its position at the attachment 174C to the attached position 176.

Figure 6A:
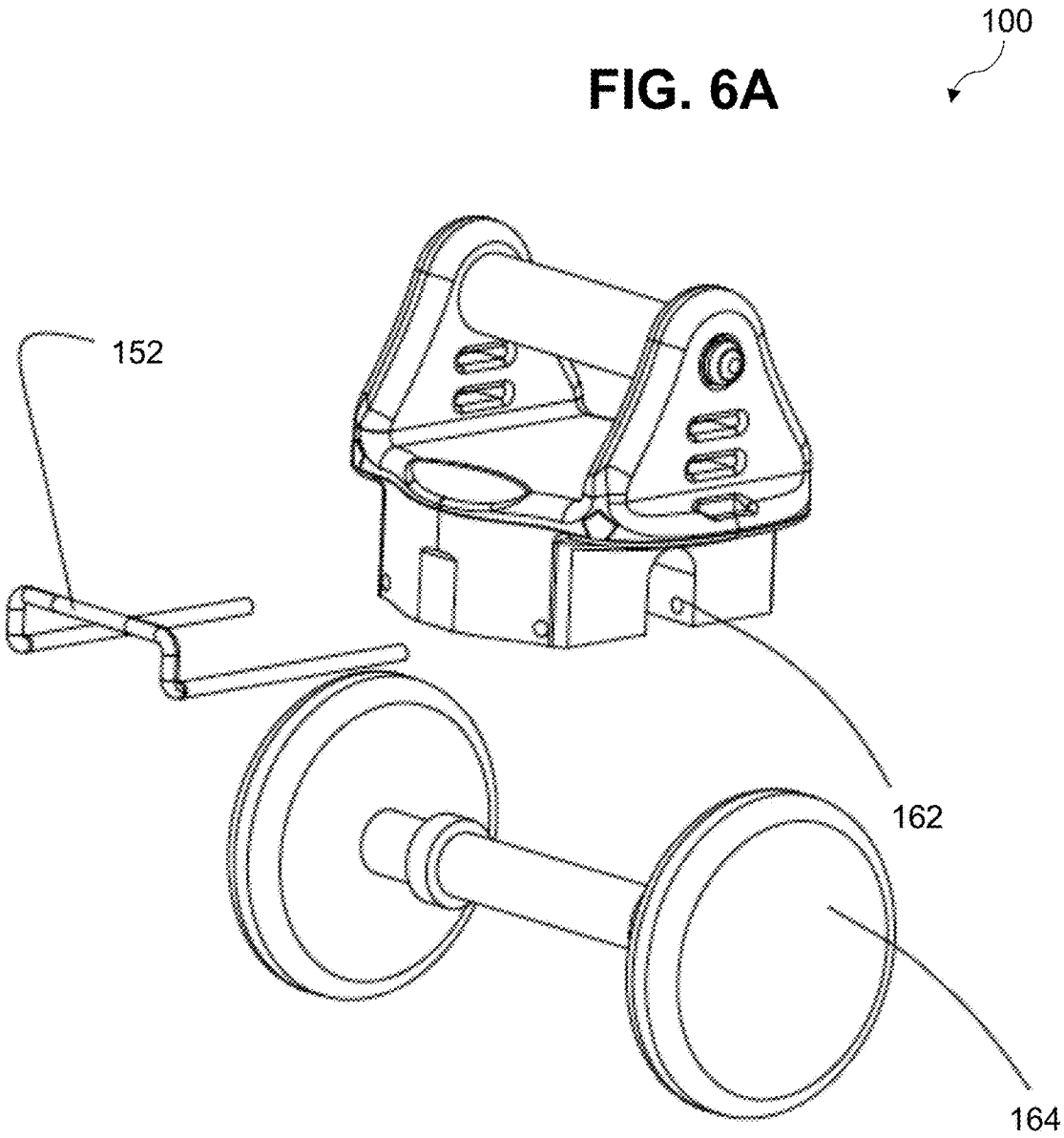
FIG. 6A and FIG. 6B depict perspective view of a means to affix a dumbbell to a grip of a physical fitness grip tool, according to at least some embodiments described herein.
Figure 6B:
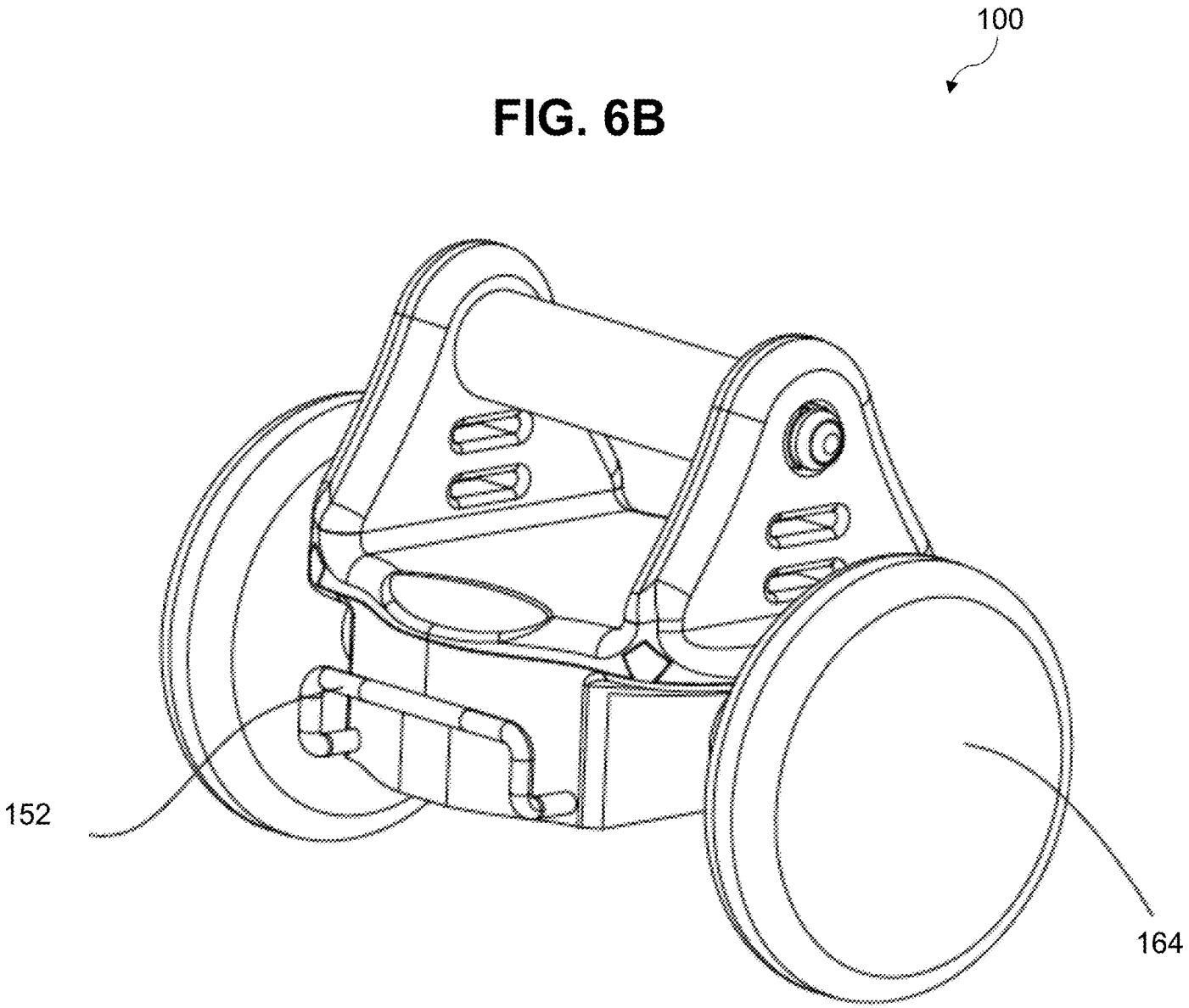

In another example, and as shown in FIG. 6A, the second side 108 of the planar portion 104 of the grip component 102 comprises a receiving channel 162 configured to receive a handle of the second attachment (e.g., the dumbbell 164) therein. Once received, the bail 152 is used to secure the second attachment (e.g., the dumbbell 164) to the physical fitness grip tool 100, as shown in FIG. 6B.

To releasably attach the two grips together, the second side 108 of the planar portion 104 of the grip component 102 of each of the two grips are joined and the removable bail 152 is inserted through holes 390 (as shown in FIG. 2A) in one of the two grips, thus traversing the length of the grip parallel to the bottom surface and securely engaging with the cylindrical groove 153. In other examples, the removable bail 152 comprises a quick disconnect/quick release feature.

It should be appreciated that the user may utilize both of these grips affixed together by grabbing the handle 114 of one grip and performing a bicep curl for improving biceps, triceps, and forearm strength by, for example, pulling the right arm towards the right shoulder while resisting this motion with slightly less pressure with the left hand.

In another illustrative example, the second side 108 of the planar portion 104 of the grip component 102 for each of the two grips touches a floor or a horizontal surface. The user may then grab the handle 114 of each of the two grips and perform push-ups.

Figure 4:
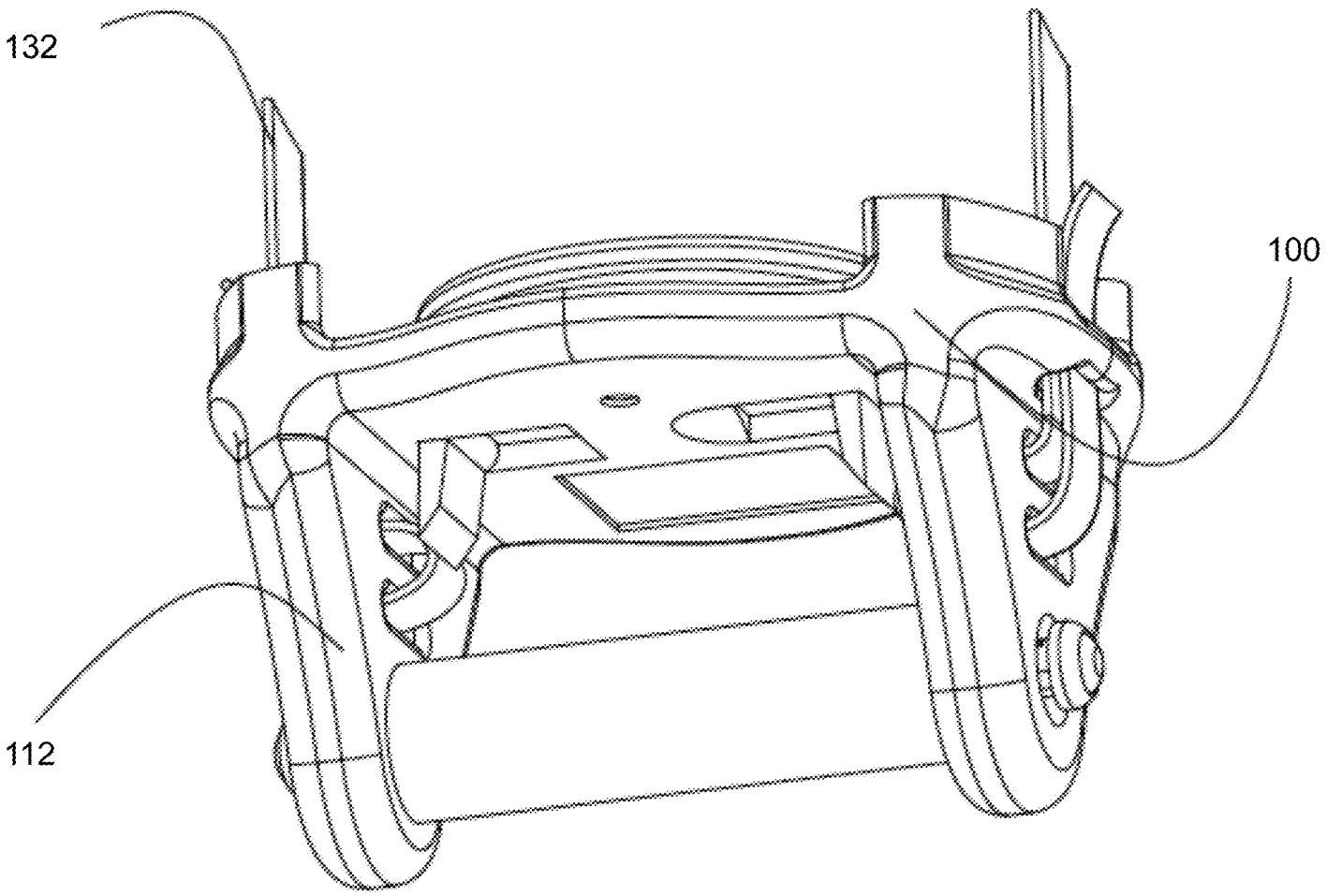
FIG. 4 depicts a perspective view of a grip of a physical fitness grip tool that utilizes bands, according to at least some embodiments described herein.

In some examples, each of the first component 110 and the second component 112 comprise strap locks 134, as shown in FIG. 3 and FIG. 4, such that the user may weave straps 132 through the strap locks 134. The strap locks 134 lock and align the straps 132 that can be secured to other stationary objections, such as an eye hook anchored to the ceiling, wall or floor, as well as monkey bars, swing set, goal post, a pull-up bar, a tree limb, or a similar structure to perform pull-ups. The straps 132 can thus provide access to many suitable counterweights or anchors for various exercises. In one example, rigid straps may be attached to a ceiling anchor or pull up bar, allowing a user to perform pull-ups. In another example, flexible straps may be attached to a floor or wall, allowing a user to perform resistance exercises such as bicep curls, triceps extension, squats, upper back rows, etc.

Figure 18:
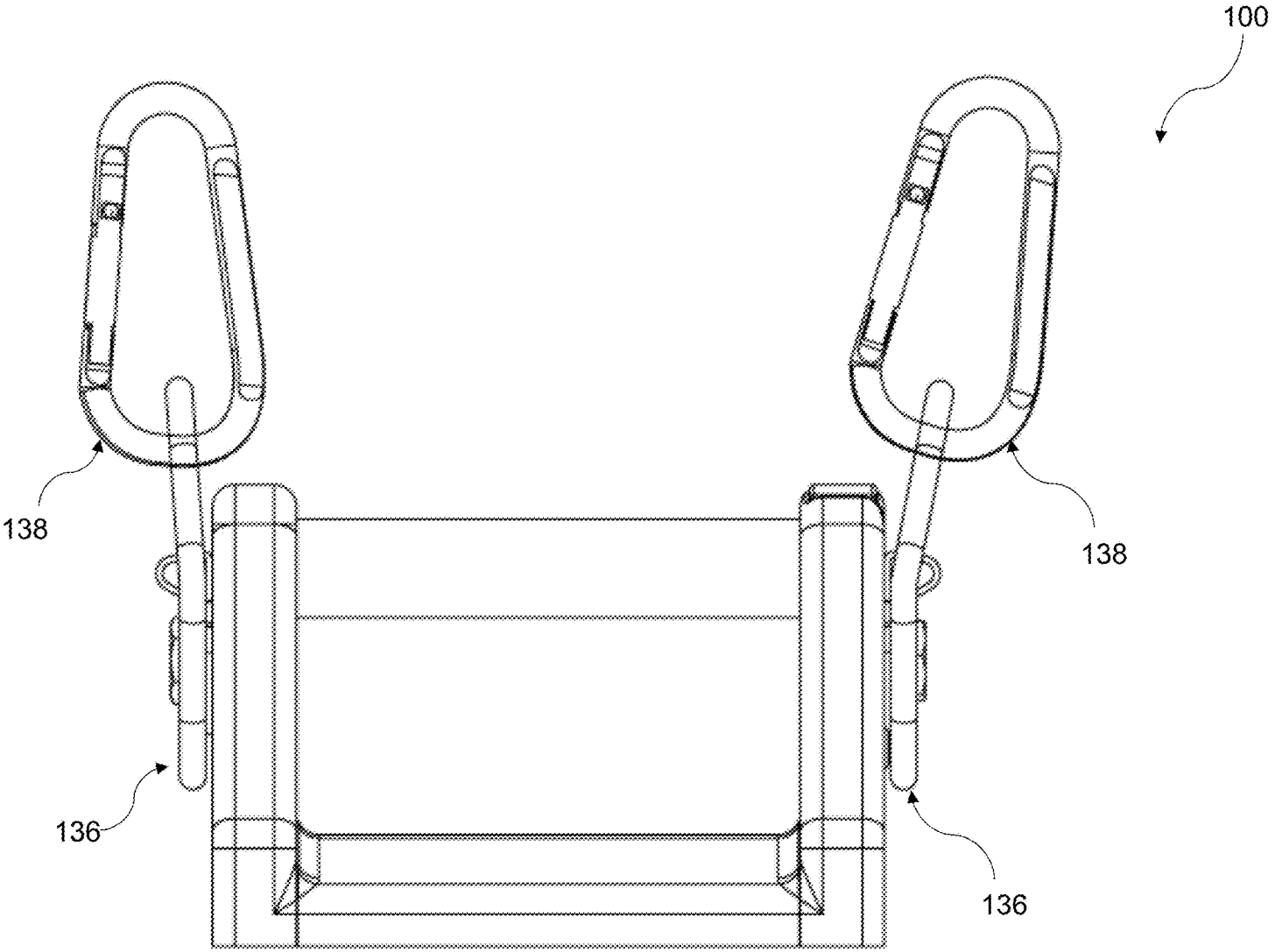
FIG. 18 depicts a perspective view of a grip of a physical fitness grip tool comprising carabiners, according to at least some embodiments described herein.

In another example, and as depicted in at least FIG. 9, FIG. 10, FIG. 11, FIG. 12, FIG. 13, FIG. 14, FIG. 15, FIG. 18, FIG. 20, FIG. 21, FIG. 22, FIG. 23, FIG. 24, FIG. 25, and FIG. 26, one or more of first component 110 and/or the second component 112 may comprise "V-rings" 136. Each of the V-rings 136 may be affixed to an external surface of the first component 110 and/or the second component 112 by any means, such as a bolt and/or screw. A carabiner 138 (as shown in FIG. 18) can clickily be clipped onto the V-ring 136 for faster pull-up installation. In other examples, the V-rings 136 can be used to secure a rope to perform jump rope exercises. Moreover, in some examples, a cam locking mechanism may be used with this implementation. In another example, a strap design may be used that comprises continuous loops approximately every 4" or so such that the carabiner can snap into the V-ring and loop to get the desired height of the grips from the anchor point.

Figure 20:
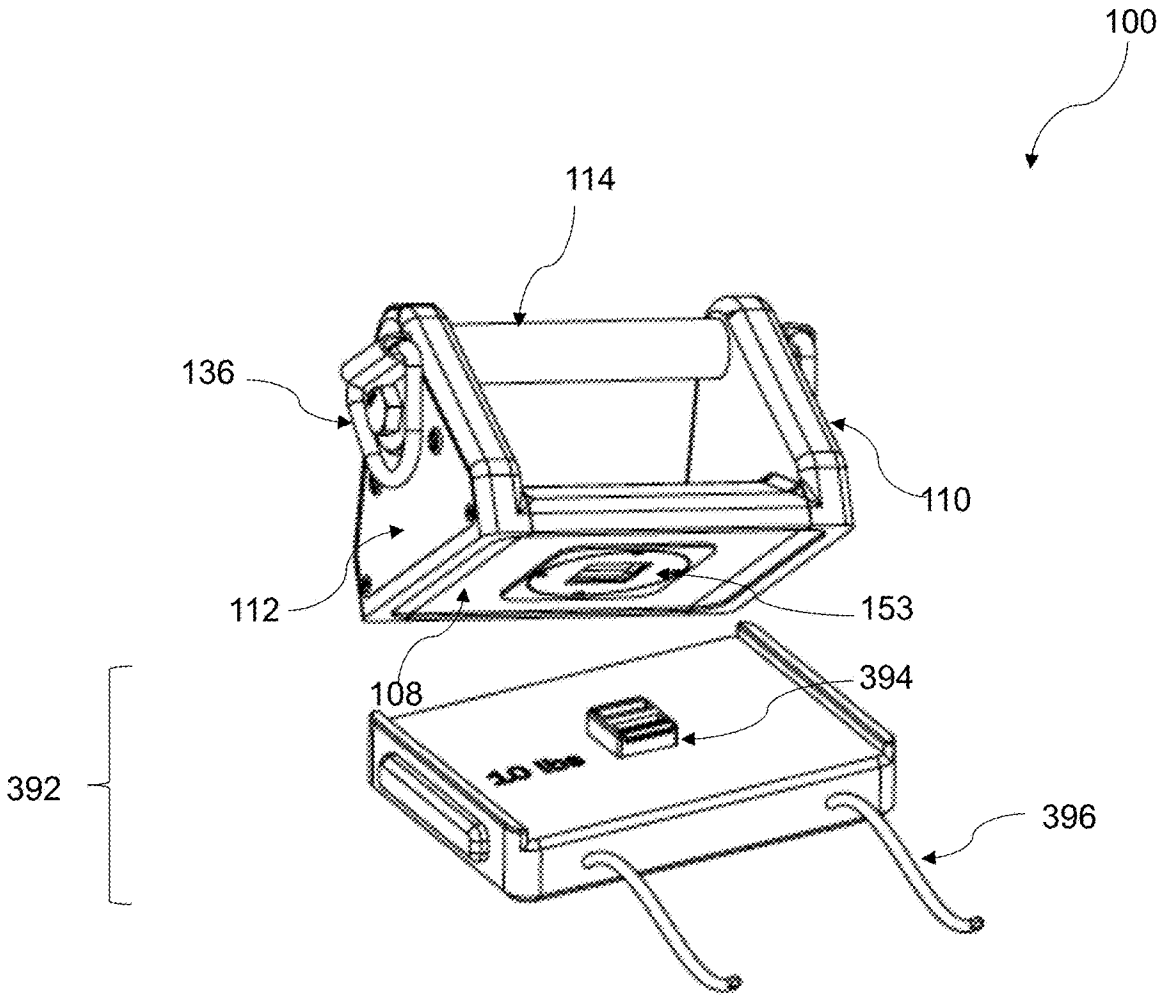
FIG. 20, FIG. 21, and FIG. 22 depict perspective views of a means to affix a custom weight to a grip of a physical fitness grip tool, according to at least some embodiments described herein.
Figure 21:
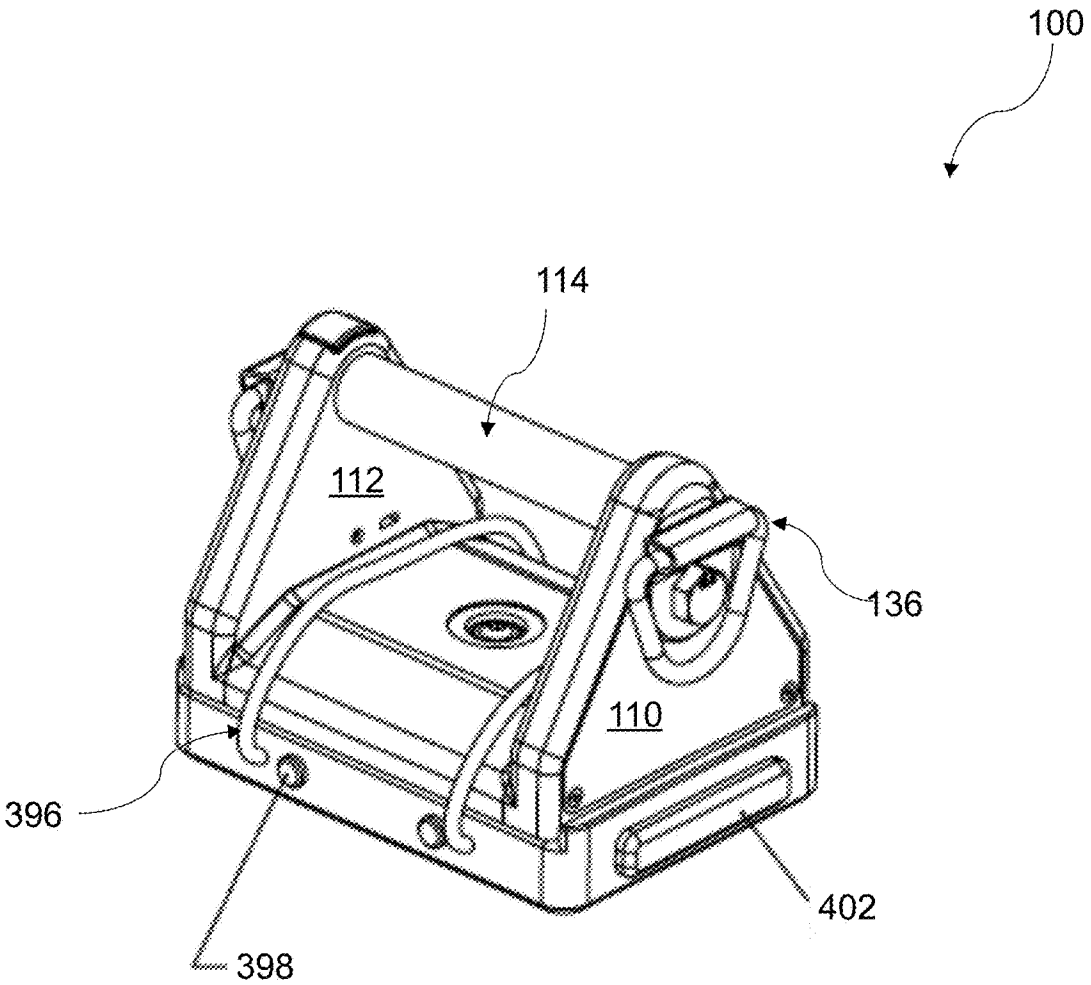
Figure 22:
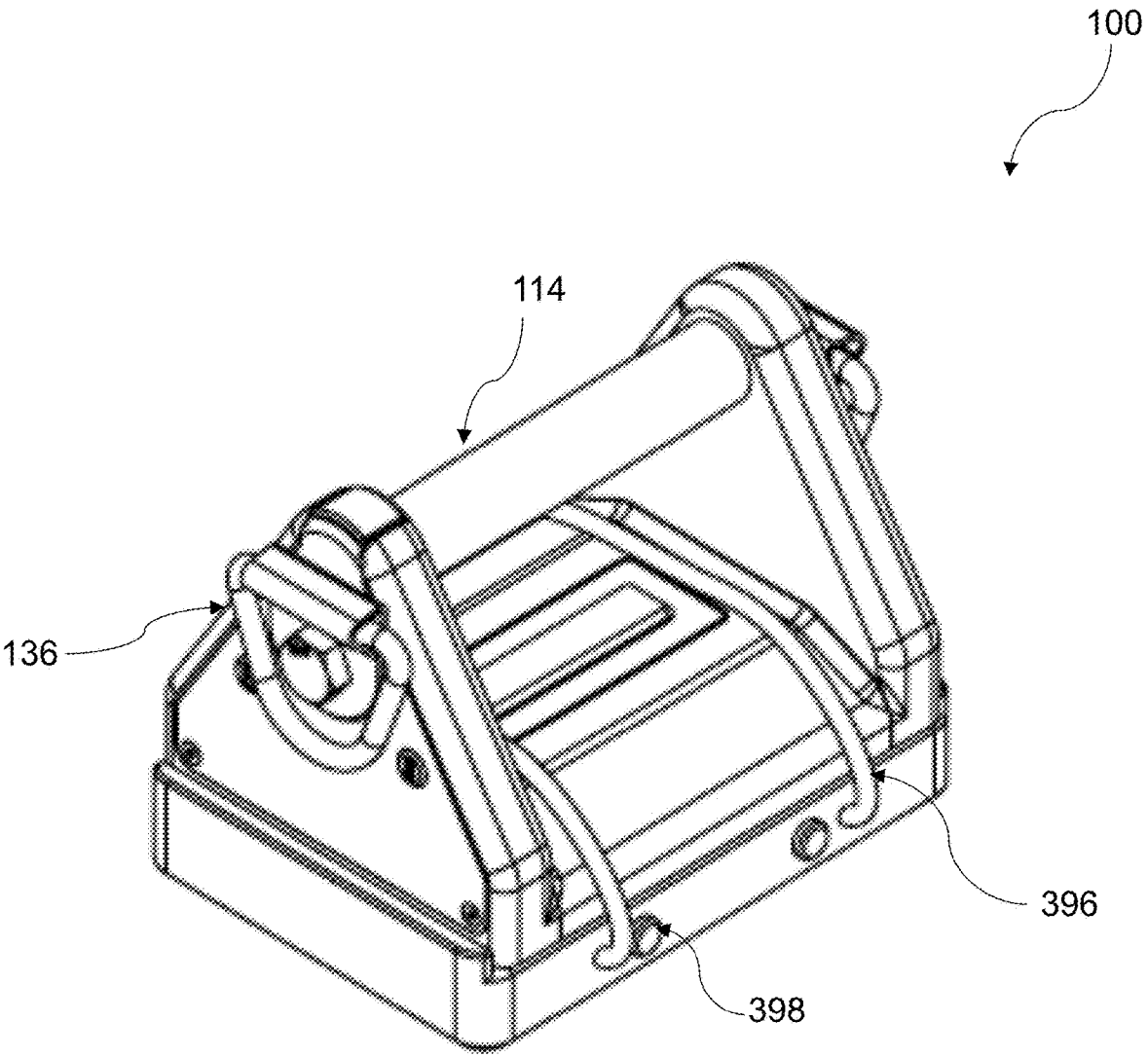

It should be appreciated that custom weights 392 may also be secured in this fashion, as shown in FIG. 20, FIG. 21 and FIG. 22, allowing the user to easily keep track of the number of repetitions and total weight lifted during dumbbell exercises. In some examples, these weight attachments clip into a locking mechanism. It should be appreciated that any locking mechanism may be used and the Applicant does not limit such herein. Each custom weight 392 may include a protruding portion 394 that is configured to be received by the second attachment component 153 on the second side 108 of the planar portion 104 of the grip component 102 of the grip. Such affixes the custom weight 392 to the physical fitness grip tool 100.

For added safety, the custom weight 392 may include one or more cables 396 that can wrap around the planar portion 104 of the grip component 102 of the physical fitness grip tool 100 and click into themselves on another side. The one or more cables 396 prevent the custom weight 392 from spinning. Moreover, the one or more cables 396 also act as a secondary safety mechanism in the event that the locking mechanism fails.

Figure 26:
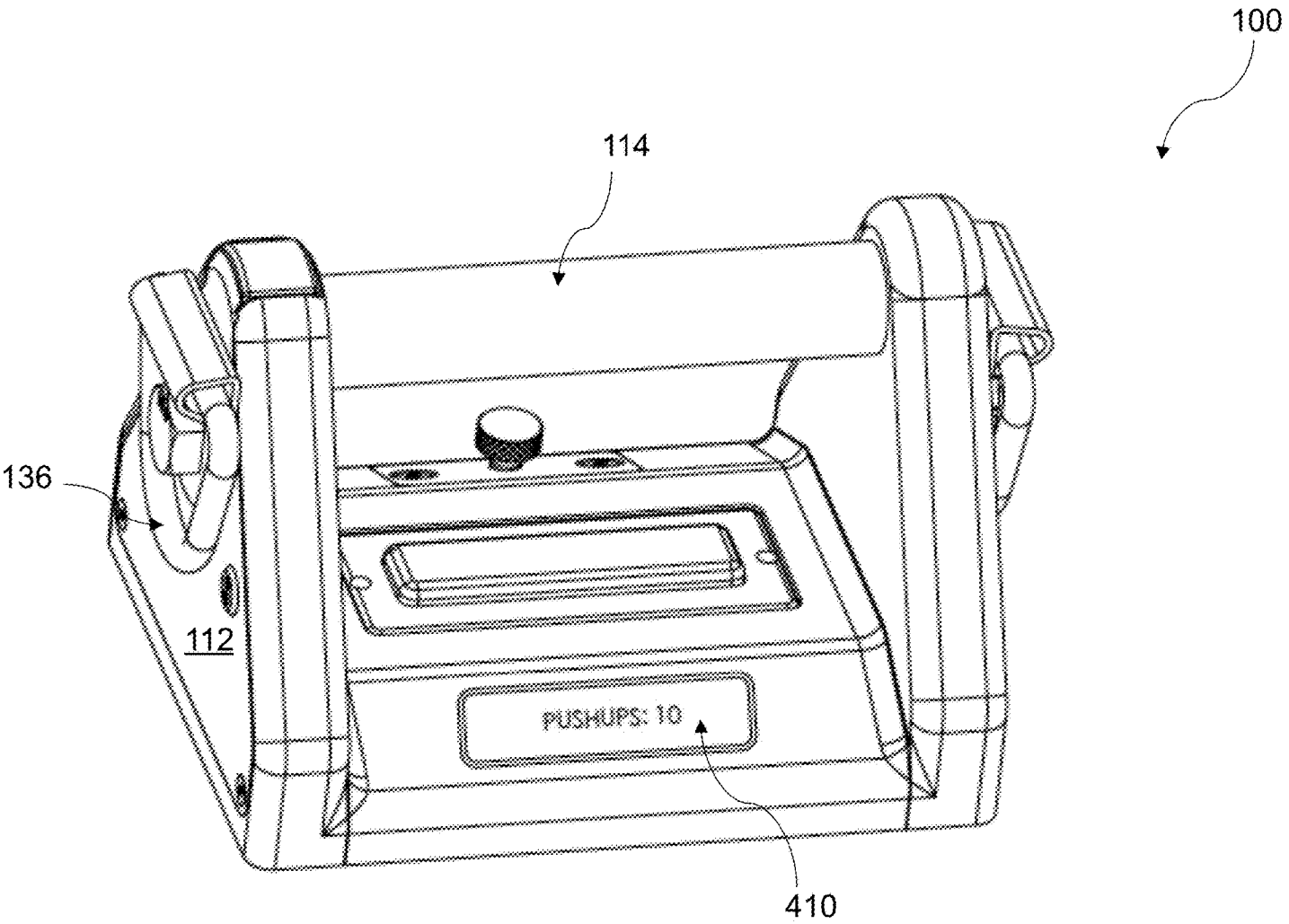
FIG. 26 depicts a perspective view of a custom weight affixed to a grip of a physical fitness grip tool, according to at least some embodiments described herein.

In some examples, the one or more cables 396 may comprise a metal material. Specifically, as shown in FIG. 21, when the user wishes to release the custom weight 392 from the physical fitness grip tool 100, the user executes a first button 398 to release the one or more cables 396. Next, the user executes a second button 402 to release the custom weight 392 from the physical fitness grip tool 100. Such release may be a quick release. FIG. 26 depicts the physical fitness grip tool 100 having the custom weight 392 affixed thereto. It should be appreciated that the display is depicted as the display 410 in FIG. 26.

Figure 23:
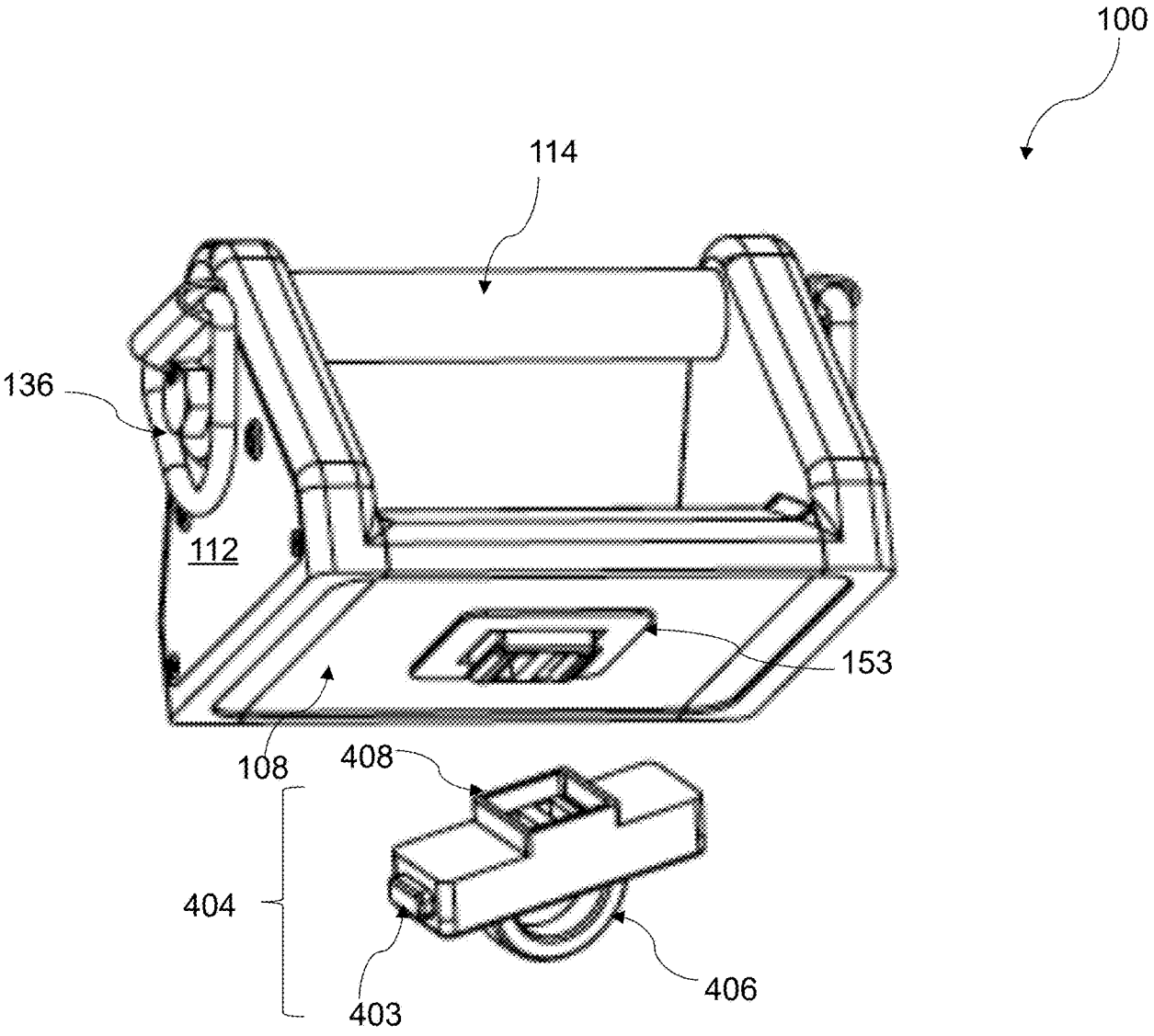
FIG. 23, FIG. 24, and FIG. 25 depict perspective views of a means to affix an attachment to a physical fitness grip tool, according to at least some embodiments described herein.
Figure 24:
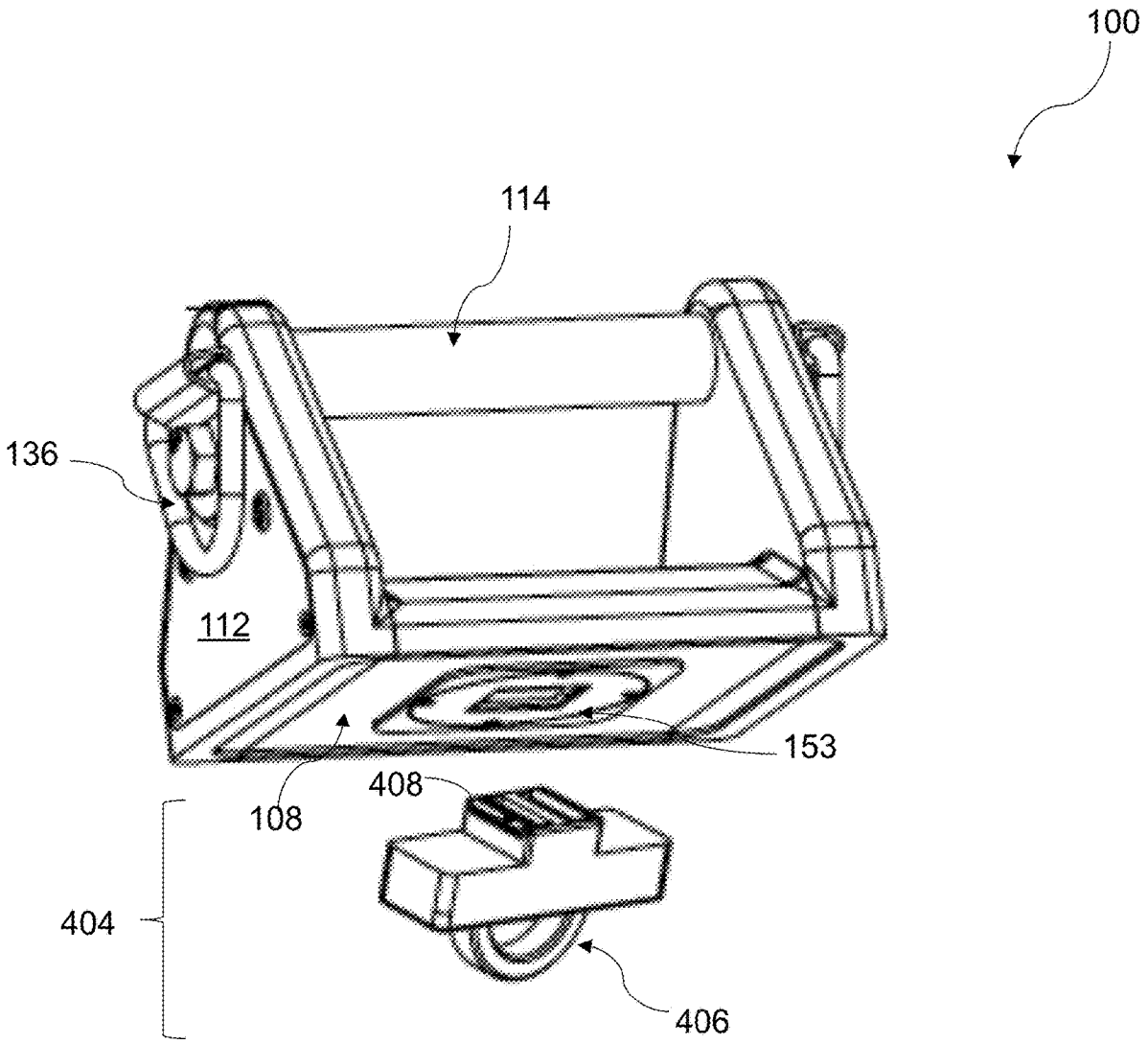
Figure 25:
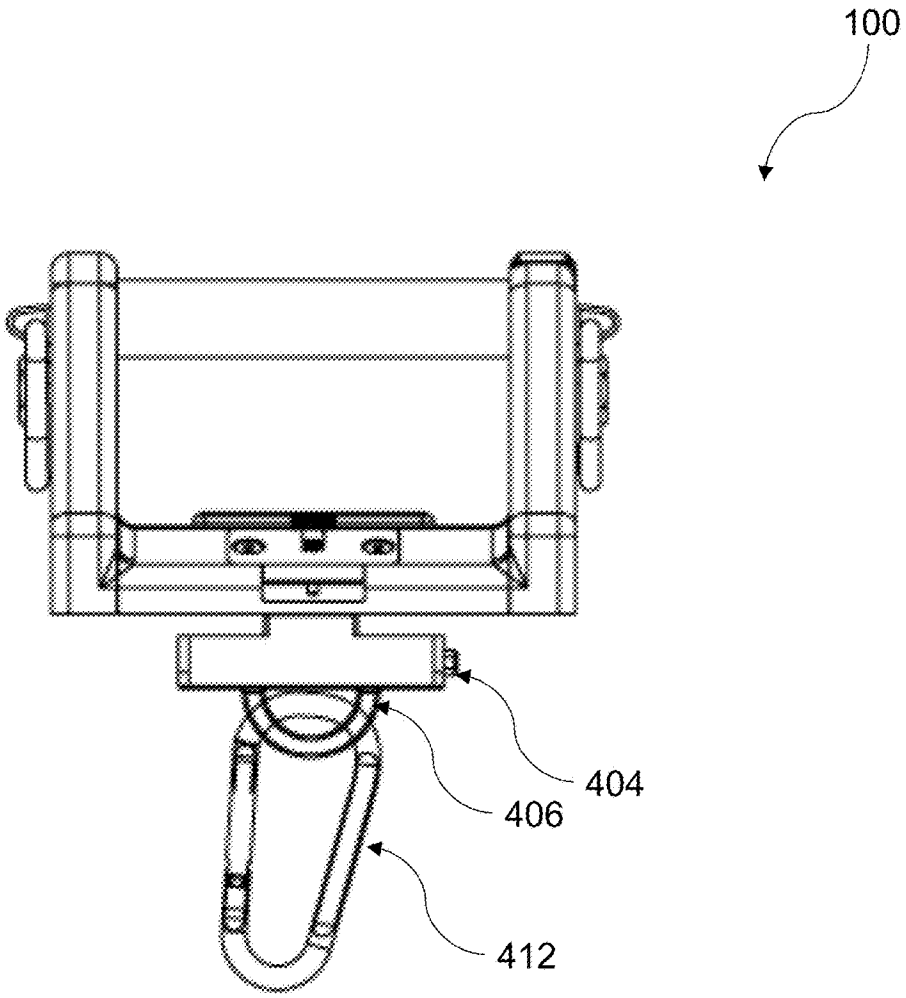

In another example, and as depicted in FIG. 23, FIG. 24, and FIG. 25, a connect device 404 may be affixed to the physical fitness grip tool 100. The connect device 404 may include a first side disposed opposite a second side, where the first side includes a protruding portion 408 and the second side may include an attachment means 406. The protruding portion 408 of the connect device 404 may be configured to engage the second attachment component 153 to affix the connect device 404 to the physical fitness grip tool 100.

In this example, a carabiner 412 may be received through the attachment means 406, as shown in FIG. 25. In some examples, a rope, straps, or an elastic band may be secured to the physical fitness grip tool 100. Specifically, the rope or the band attaches to the attachment means 406 on the connect device 404. The rope or the band comprises a locking mechanism (not shown) that allows the user to decrease or increase the length of the band to increase or decrease the resistance. A button 403 (of FIG. 23) is present on the locking mechanism that allows the user to release it from the second side 108 of the planar portion 104 of the grip component 102. Moreover, in some examples, the release button for the locking mechanism may be present on the planar portion 104. The band or the rope may be used for self-resistance exercises. In a further example, the fitness band, straps, or jump rope may be directly be clipped using a carabiner onto the male and female end of the quick connect. The benefit of this over the V-ring is that it requires the use of one resistance band instead of two resistance bands and one can utilize the ball bearings of the grip connector to easily rotate the bands so they don't twist.

Figure 14:
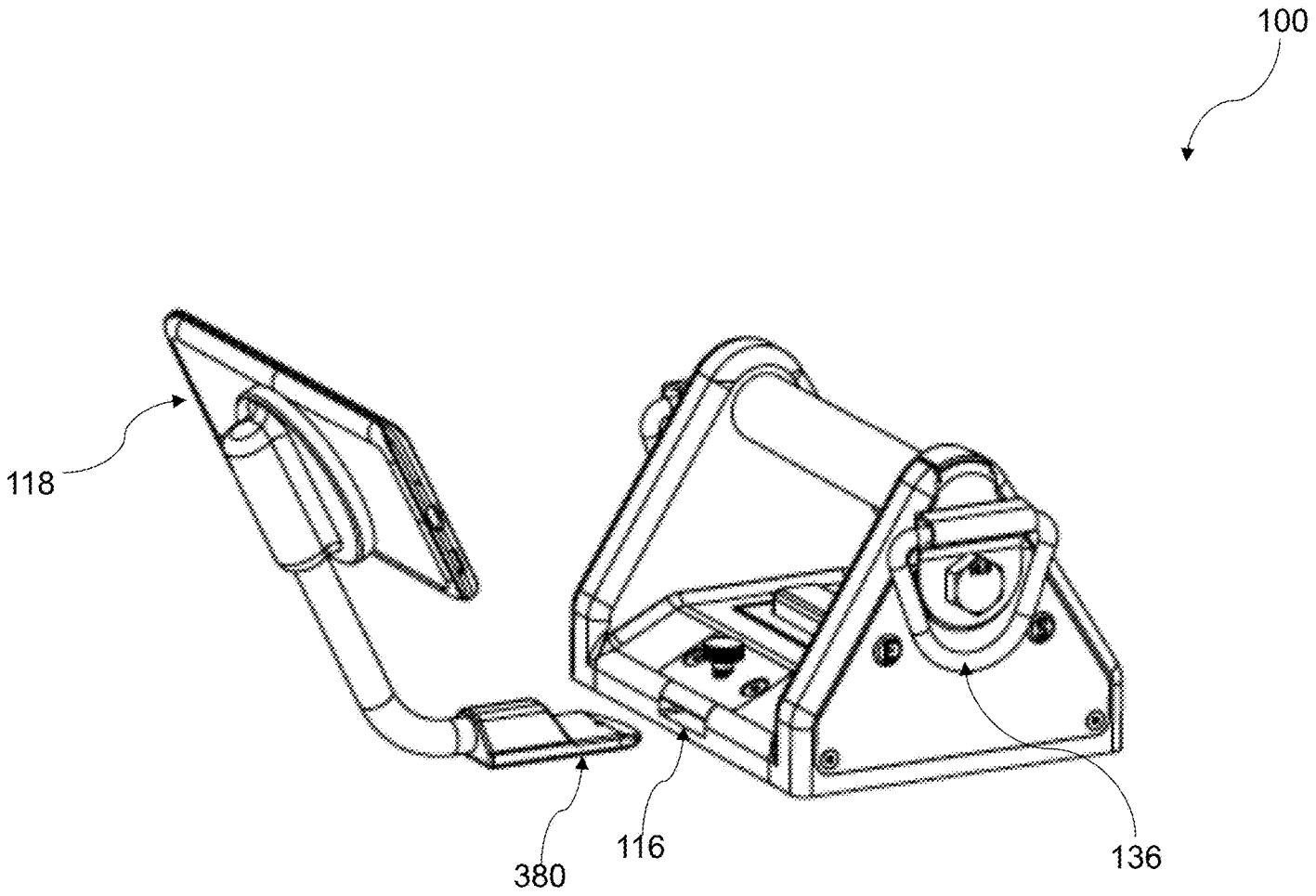
FIG. 14 depicts a perspective view of a grip of a physical fitness tool configured to receive an attachment therein, according to at least some embodiments described herein.
Figure 15:
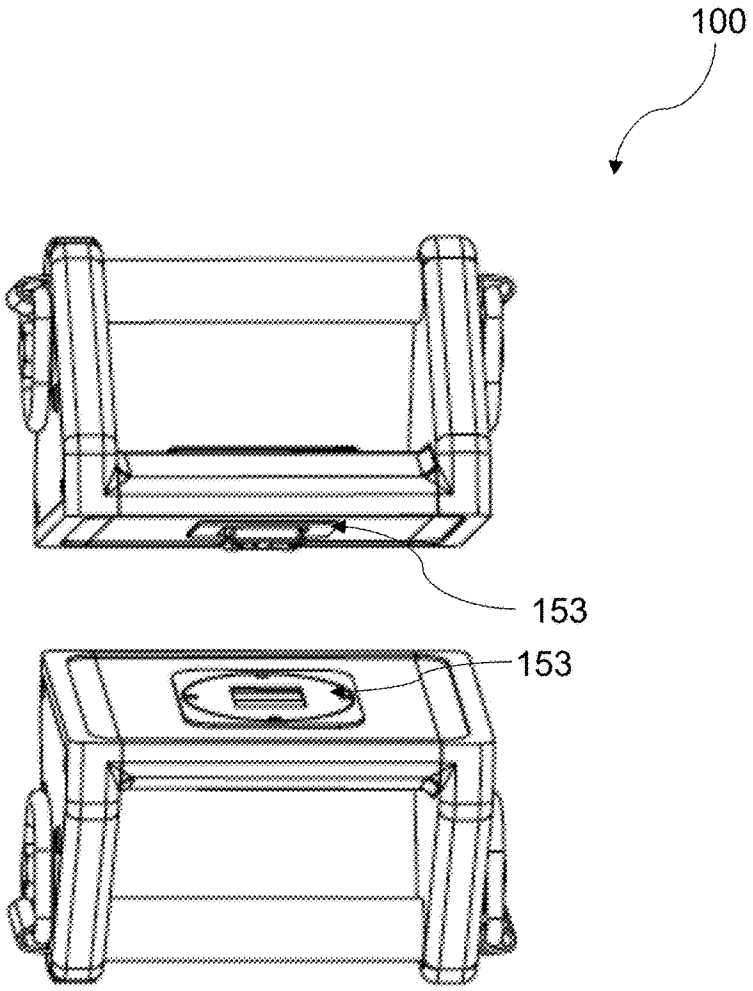
FIG. 15, FIG. 16, and FIG. 17 depict perspective view of a means to affix a first grip to a second grip of a physical fitness grip tool, according to at least some embodiments described herein.
Figure 16:
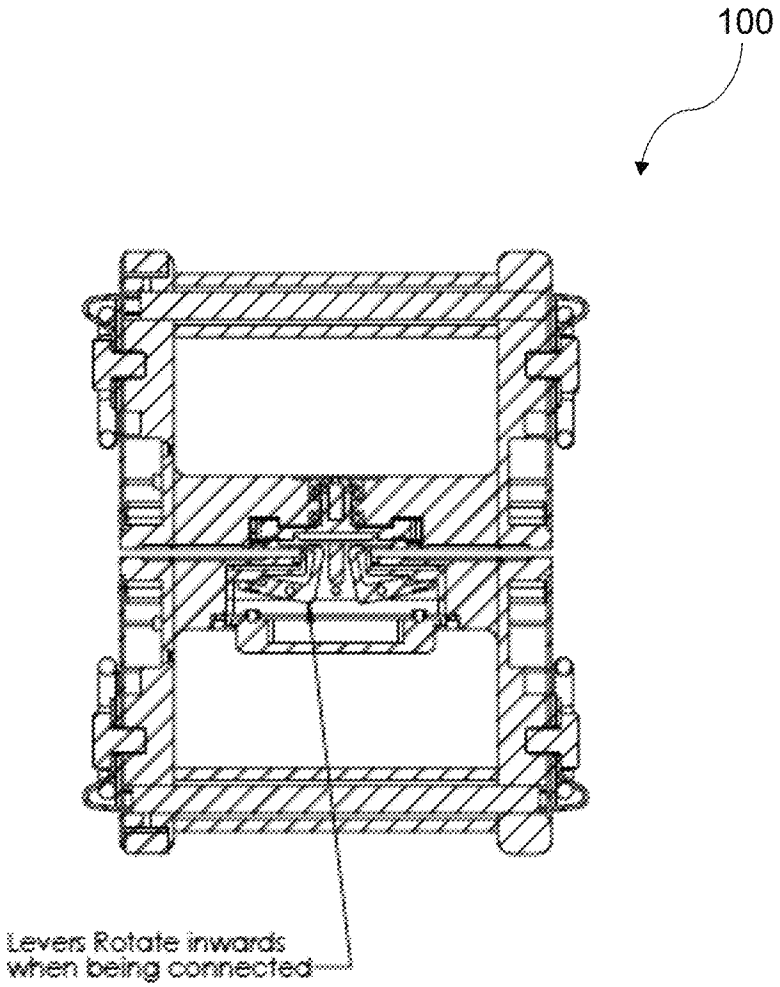
Figure 17:
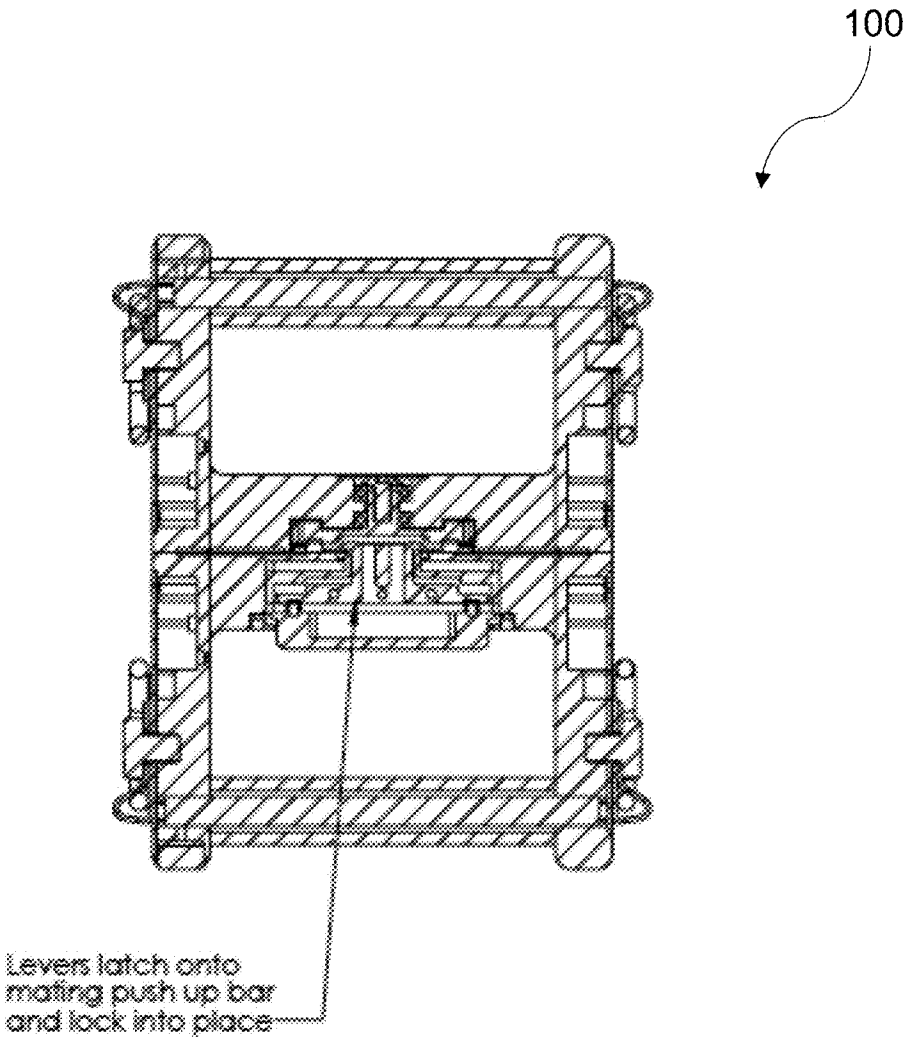

Moreover, in examples and as shown in FIG. 14, the planar portion 104 of the grip component 102 further comprises a receiving portion 116. The receiving portion 116 receives a protruding portion 380 of a second attachment therein. In some examples, the second attachment further comprises a flexible gooseneck affixed to a display 118, such that the display 118 is closer to the users eyes so they can easily see the data and how to perform each exercise.

Figure 19:
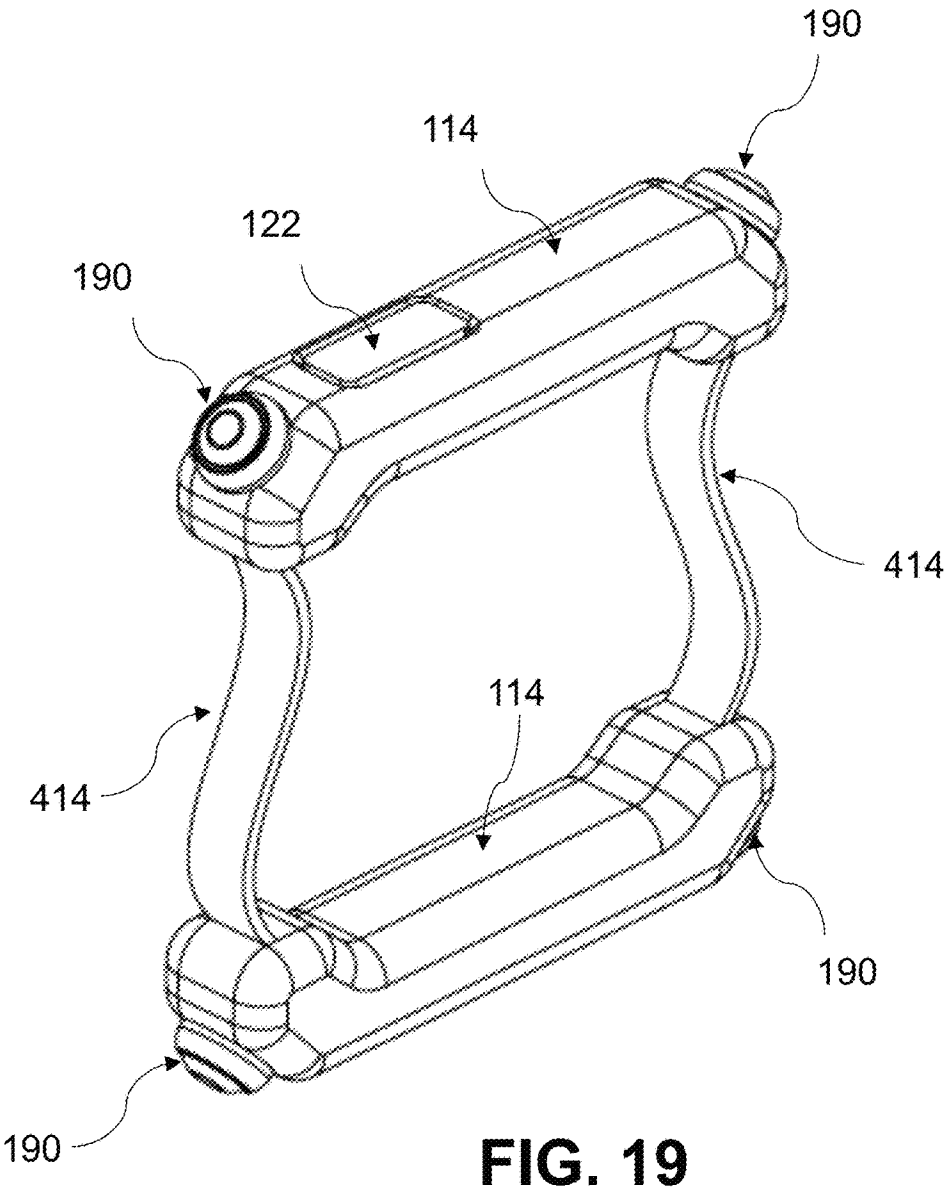
FIG. 19 depicts a perspective view of a handheld physical fitness grip tool, according to at least some embodiments described herein.

Moreover, a portable version of the physical fitness grip tool 100 is depicted in FIG. 19. The portable physical fitness grip tool may be used for dynamic resistance exercises, isometric exercises, body weight resistance exercises, dumbbell weight resistance exercises, strap resistance exercises, band resistance exercises, jump rope exercises, and double workout advantage exercises, according to particular embodiments. The portable physical fitness grip tool comprises two opposing handles 114, locking cables 414, the display 122, and one or more buttons 190. It should be appreciated that the quantity of the one or more buttons 190 are not limited to any particular quantity.

The locking cables 414 are coupled to strain gauges on the handles 114 that measure push/pull forces. The strain gauges are coupled to a battery and the electronics unit 150 that keep track of weight and repetition metrics and display results on the display 122. In particular embodiments, the portable version of the physical fitness grip tool 100 of FIG. 19 is small enough to fit in a pant pocket or a small bag, making it highly portable. As shown in FIG. 19, the grip of the portable version of the physical fitness grip tool 100 is designed for users who only wish to use the grips for dynamic resistance, self-resistance or isometric exercises, and want to use a smaller version or profile of the grips. Each handle 114 may be approximately 5.5" in length and 1" in diameter. When a user executes a first button of the one or more buttons 190, a signal is transmitted to the electronics unit 150 to count a number of repetitions. When the user executes a second button of the one or more buttons 190, another signal is transmitted to the electronics unit 150 to progress to a next exercise.

In some examples, the physical fitness grip tool 100 may comprise an accelerometer (not shown) that allows the user the option to automatically count the repetitions of a particular exercise and identify the type of exercise the user is performing without using the one or more buttons 190. Manual repetition counters can be used augment this function.

Figure 9:
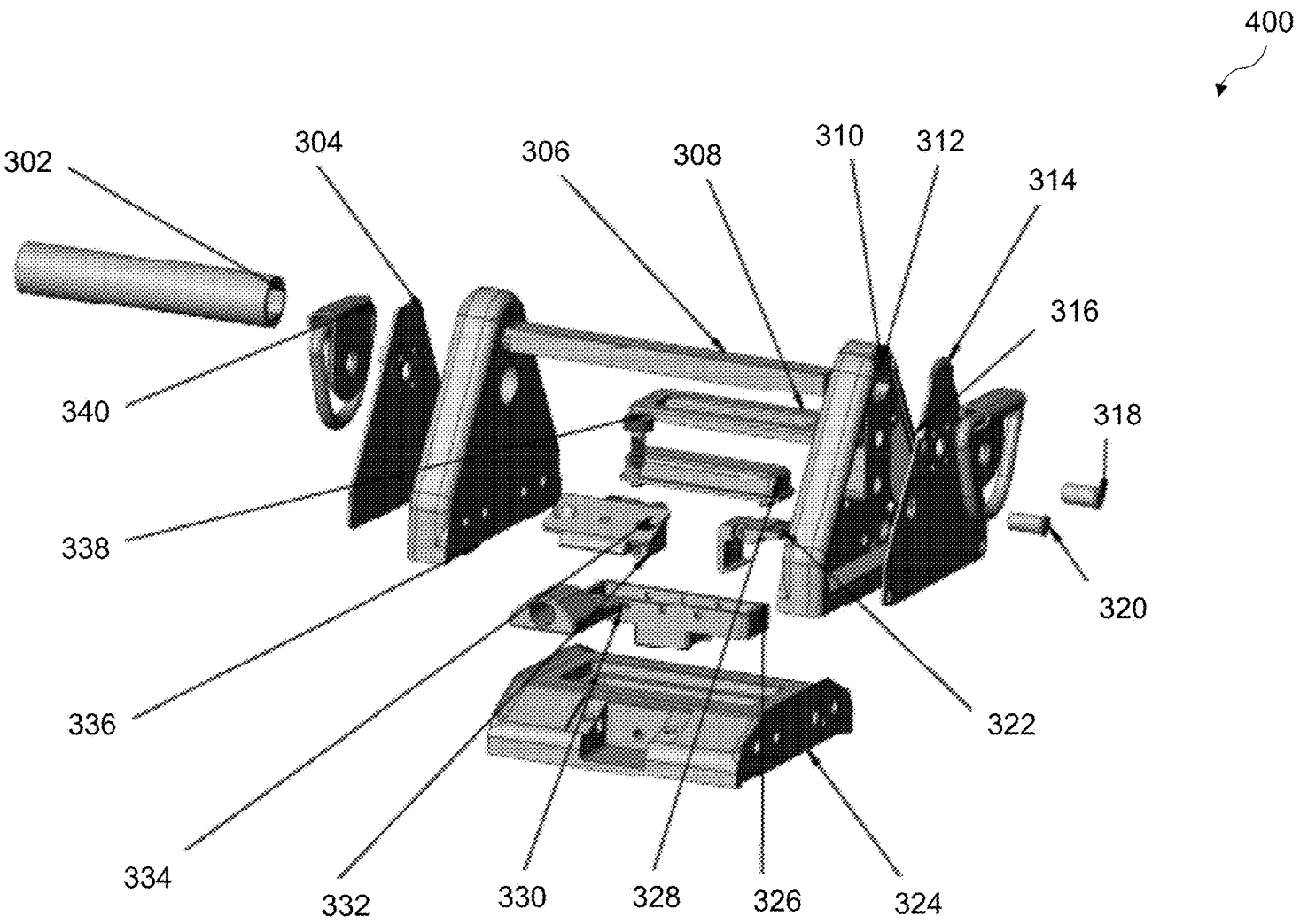
FIG. 9, FIG. 10, and FIG. 11 depict exploded views of a physical fitness grip tool, according to at least some embodiments described herein.
Figure 10:
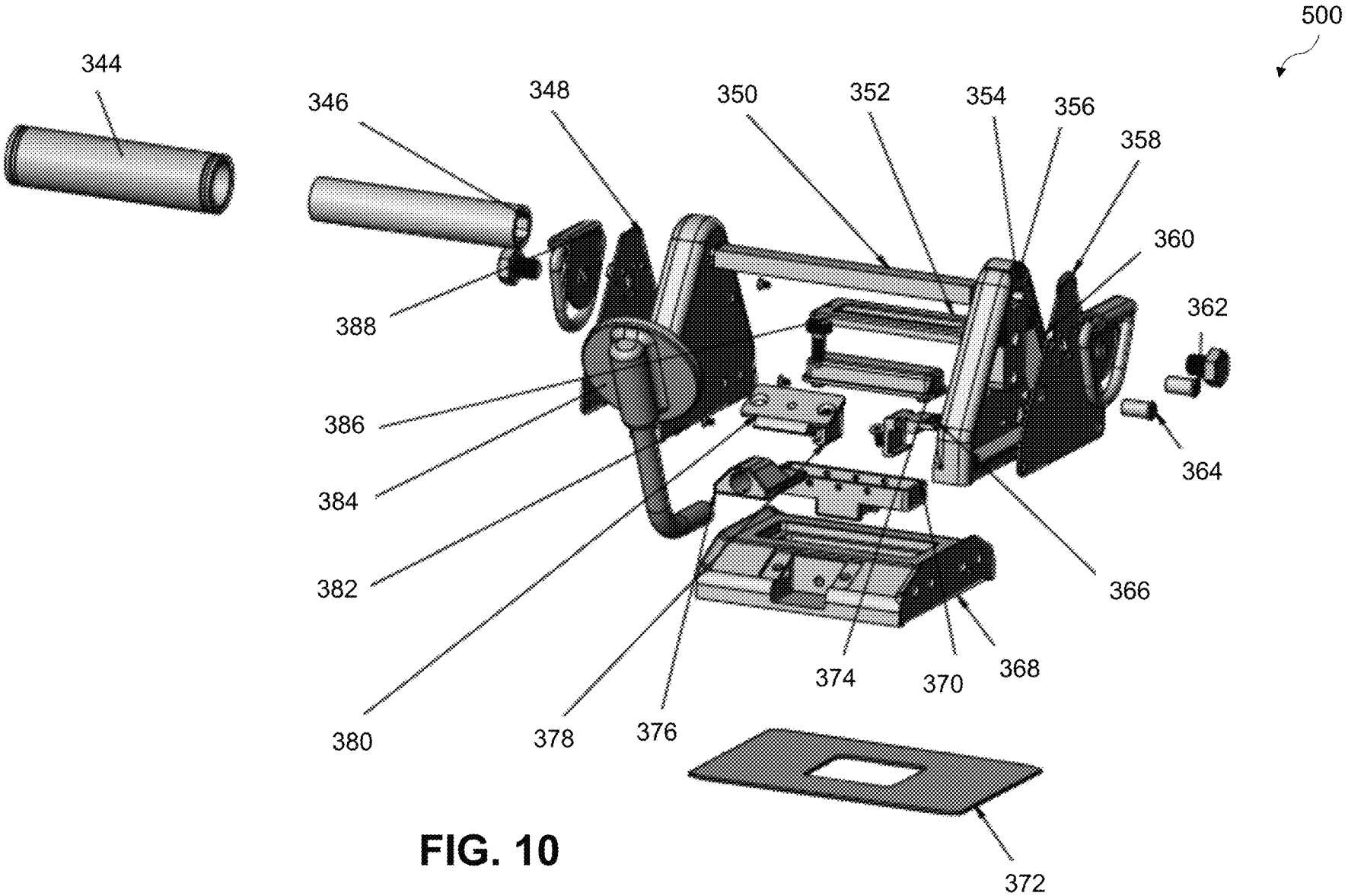
Figure 11:
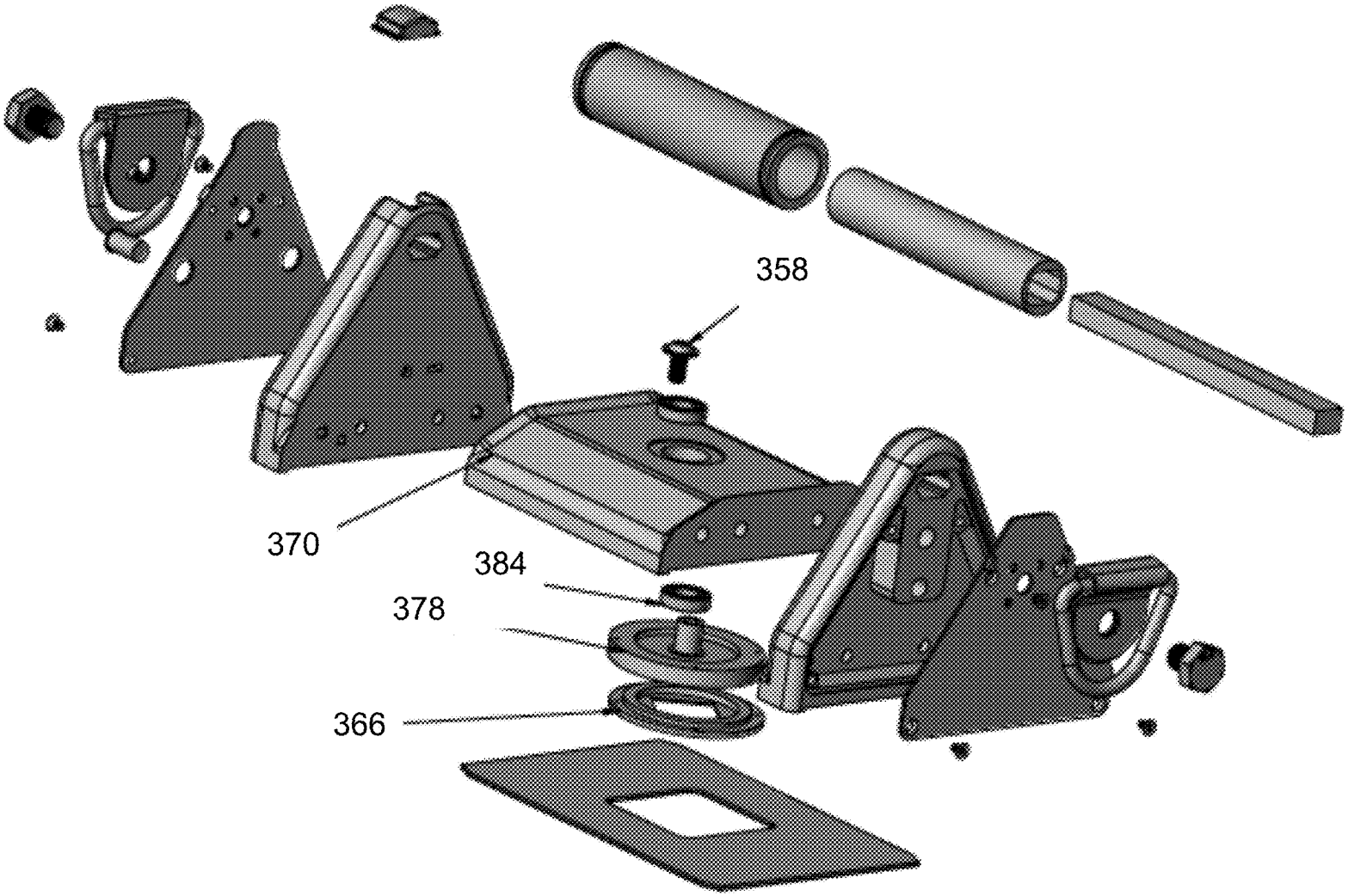

It should be appreciated that an exploded view of the physical fitness grip tool 100 is depicted at least in FIG. 9, FIG. 10, and FIG. 11. As shown in FIG. 9, the physical fitness grip tool 100 includes a strain gauge cover 302, a first button 310, an attachment means 334 for a smartphone, a male base 324, a PCB button 312, a cover for a male base 308, a second button 318, a third button 320, a PCB pillar 316, a non-PCB pillar 336, a PCB cover 314, a phone holder insert 330, a force sensor beam 306, a non-PCB cover 304, a ring 340, a carriage 326, a first lever 332, a second lever 322, a component 338, and a release button 328. As shown in FIG. 10, the physical fitness grip tool 100 includes a strain gauge cover 346, a first button 354, a phone clamp 380, a male base 368, a PCB button 356, a cover for the male base 352, a second button 364, a third button 362, a PCB pillar 360, a non-PCB pillar 382, a PCB cover 358, a phone holder insert 376, a force sensor beam 350, a non-PCB cover 348, a ring 388, a component 386, a carriage 370, a first lever 378, a second lever 366, a release button 374, a phone holder 384, a rubber bottom 372, and a grip 344. As shown in FIG. 11, the physical fitness grip tool 100 can also include a fixation component 358 (e.g., a screw/bolt), a ring component 384, a bearing axle 378, a hooks inlet 366, and a bearing base 370.

As explained supra, for the physical fitness grip tool 100, the handle component 114 is disposed between the first component 110 and the second component 112. The handle component 114 is perpendicular to the first side 106 of the planar portion 104 of the grip component 102. Moreover, the handle component 114 includes the one or more sensors 142 or internal sensing devices. The one or more sensors 142 or internal sensing devices are configured to measure a force applied to the handle component 114 and transmit the measurement of the force to the electronics unit 150. Further, in order to measure workout performance for all varieties of exercises, the one or more sensors 142 or internal sensing devices measure the bend in the handle 114 when they are pushed or pulled. In particular embodiments, strain gauges are disposed within the handle 114 and are coupled with the electronics device 150 configured to measure the bend of the center of each handle with respect to the ends of the handle 114. The accelerometer and the strain gauge (e.g., the one or more sensors 142) also permit the user the option to automatically keep track of what exercise they are performing. The automatic repetition counter and exercise identifier saves the user time in keeping track of the exercise regime manually. The accelerometer and exercise identifier also allow the trainer to notify the user how to perform an exercise correctly when they are performing an exercise incorrectly. It should be appreciated that other components/devices may be used to measure force that are not explicitly listed herein.

Moreover, the physical fitness grip tool 100 described herein can be used to perform a wide variety of strength training and cardiovascular exercises. The physical fitness grip tool 100 is battery powered and compact, allowing a user to conveniently travel with it and perform exercises in any setting, e.g., at home, at work, while commuting, outside etc. When engaged, the user may push or pull the handle(s) 114 together/apart to perform strength exercises. The physical fitness grip tool 100 may also be separated from a second physical fitness grip tool 100 and used for many additional strength or cardiovascular exercises, such as push-up and pull-up variations, jump rope, band resistance, strap resistance, boxing, or dumbbells through the use of a dumbbell accessory or as light dumbbells without the use of the dumbbell accessory.

The electronics unit 150 of FIG. 27 includes a processor, a memory, and a fitness application 124. It should be appreciated that the electronics unit 150 may obtain power from any suitable power supply such as one or more rechargeable or non-rechargeable batteries, external batteries, power outlets, etc. The fitness application 124 of the electronics unit 150 is configured to: process and maintain data associated with exercise metrics of the user. Moreover, the electronics unit 150 may comprise wireless capabilities, e.g., Bluetooth, Bluetooth Low Energy (Bluetooth LE), near-field communication (NFC), WiFi, etc. configured to communicate with a separate computing device (e.g., a computing device 116) of FIG. 27. The computing device 116 may include a computer, a laptop computer, a smartphone, a tablet, a cloud computer, a smart watch, a smart electronic, a wearable electronic (e.g., Fitbit®), a smart television (e.g., AppleTV®), among other examples not explicitly listed herein.

The computing device 116 may be associated with the user utilizing the physical fitness grip tool 100 or with another user, such as a trainer or a physical therapist. It should be appreciated that the physical fitness grip tool 100 described herein may be used by physical fitness trainers, commercial gyms, fitness studios, physical therapists, nursing homes, and hospitals to check on the progress of their patients or customers (e.g., see what exercises their patients are performing and how often their patients are performing these exercises). The computing device 116 includes numerous components, such as: a graphical user interface (GUI) 110, a processor 234, a memory 224, and the fitness application 124, of FIG. 27. The components of the computing device 116 will be discussed in greater detail herein.

Wireless LANs (WLANs) in which a mobile user can connect to a local area network (LAN) through a wireless connection may be employed for wireless communications. Wireless communications can include communications that propagate via electromagnetic waves, such as light, infrared, radio, and microwave. There are a variety of WLAN standards that currently exist, such as Bluetooth®, Bluetooth LE, and IEEE 802.11.

By way of example, Bluetooth products may be used to provide links between mobile computers, mobile phones, portable handheld devices, personal digital assistants (PDAs), and other mobile devices and connectivity to the Internet. Bluetooth is a computing and telecommunications industry specification that details how mobile devices can easily interconnect with each other and with non-mobile devices using a short-range wireless connection. Bluetooth creates a digital wireless protocol to address end-user problems arising from the proliferation of various mobile devices that need to keep data synchronized and consistent from one device to another, thereby allowing equipment from different vendors to work seamlessly together.

An IEEE standard, IEEE 802.11, specifies technologies for wireless LANs and devices. Using 802.11, wireless networking may be accomplished with each single base station supporting several devices. In some examples, devices may come pre-equipped with wireless hardware or a user may install a separate piece of hardware, such as a card, that may include an antenna. By way of example, devices used in 802.11 typically include three notable elements, whether or not the device is an access point (AP), a mobile station (STA), a bridge, a personal computing memory card International Association (PCMCIA) card (or PC card) or another device: a radio transceiver; an antenna; and a MAC (Media Access Control) layer that controls packet flow between points in a network.

As described herein, "NFC" is a set of communication protocols for communication between two electronic devices over a distance of 4 cm or less. NFC devices can act as electronic identity documents and keycards and may be used in contactless payment systems and allow mobile payment replacing or supplementing systems such as credit cards and electronic ticket smart cards. NFC can be used for sharing small files such as contacts, and bootstrapping fast connections to share larger media such as photos, videos, and other files.

The electronics unit 150 is configured to transmit the data associated with the exercise metrics of the user to the computing device 116 over a network 152. The network 152 may be any communications network suitable for transmitting data between computing devices, such as, by way of example, a Local Area Network (LAN), a Wide Area Network (WAN), Metropolitan Area Network (MAN), Personal Area Network (PAN), the Internet, wireless networks, satellite networks, overlay networks, or any combination thereof.

The computing device 116 may also access a remote server 154 to transmit and record fitness data and access any suitable interactive interfaces related to fitness training with the fitness grip tool 100. A user of client system described and depicted herein may interact with remote server 154 through any suitable graphical user interface, such as, by way of example, an application, web browser, web application, mobile application, etc. For example, a user may use a personal computer or smartphone to access an application or website for tracking their progress, sharing their results with other users, achieve goals, view custom workout recommendations, etc. The remote system may be any computing device or combination of devices suitable to provide application services, such as, by way of example, server computers, database systems, storage area networks, web servers, application servers, or any combination thereof.

In examples where two grips are affixed together, both grips will transfer data to the computing device 116. The fitness application 124 of the computing device 116 may summarize and sort the data received from the grips. The fitness application 124 will only display the strain gauge from one of the grips so as not to double-count the data. As an example, the fitness application 124 of the computing device 116 may provide any suitable interactive functionality, such as, by way of example and not limitation, displaying exercise routines as well as how to correctly perform each exercise by way of text, audio, video, virtual personal trainer, etc., receive and record workout metrics, display current workout metrics, notify user of important milestones reached, etc.

In additional examples, the fitness application 124 of the computing device 116 may compute various metrics associated with exercises performed with physical fitness grip tool 100. For example, the user may obtain the total weight lifted per each repetition over a time period, allowing the user to set specific weight goals and accurately measure them (e.g., lifting an elephant over the course of an entire workout). In particular embodiments, the cumulative weight lifted per time regardless of repetition and the cumulative weight lifted per repetition over a certain amount of time is computed. For example, the cumulative weight lifted per second may be computed for a workout, a particular exercise, or a set. In this manner, a user may obtain credit for lifting something regardless of whether a full repetition has been completed. In particular embodiments, the cumulative maximum weight lifted per repetition may be computed for a workout, an exercise, or a set. For this metric credit may be given once a user completes a repetition. The user can set goals to reach an array of different weight milestones (e.g., whales, busses, airplanes, trucks, tanks, and/or landmarks). The user can strive to beat their previous Weight Class Category records and users can share their results on a website to compete with or motivate others around the globe.

In some examples, the electronics unit 150 of physical fitness grip tool 100 comprises a memory and data storage capability such that if the users computing device 116 dies or is inaccessible, the user can still utilize the physical fitness grip tool 100.

In an illustrative example, a first physical fitness grip tool 100 is equipped with a Bluetooth antenna that communicates with the fitness application 124 on the computing device 116 to share workout data. The first physical fitness grip tool 100 may also communicate with the fitness application 124 via a WiFi connection (e.g., a home WiFi router). A second physical fitness grip tool 100 communicates its data to the first physical fitness grip tool 100 through a wireless radio signal, such as an nRF24-ISM 2.4 GHz radio signal. The first physical fitness grip tool 100 can then share data of both of the first physical fitness grip tool 100 and the second physical fitness grip tool 100 with the fitness application 124 through Bluetooth. The fitness application 124 may then provide any suitable interactive functionality and communicate data with a remote/cloud application through the Internet via any suitable access connection (e.g., a cellular data connection, a WiFi connection, etc.). In one example, the networked first physical fitness grip tool may also directly communicate data to the remote/cloud application.

A method using the physical fitness grip tool 100 to process and maintain data associated with exercise metrics of the user is also described herein. The method includes numerous process steps, such as: receiving a signal from the one or more buttons located on the grip component 102 at the fitness application 124 of the electronics unit 150. The signal indicates that the user is performing an exercise. Next, the method includes: receiving, by the fitness application 124 of the electronics unit 150, a measurement of force applied to the handle component 114 from the one or more sensors 142. The method further includes: processing, by the fitness application 124 of the electronics unit 150, the signal and the measurement of force. Next, the fitness application 124 of the electronics unit 150 may transmit the signal, the measurement of force, and other exercise metrics to the computing device 116 via WiFi, Bluetooth, or Bluetooth Low Energy.

Thus, the physical fitness grip tool 100 can keep track any suitable weight-lifting metric, such as cumulative weight lifted per second, cumulative maximum weight lifted per repetition, average maximum per repetition, total repetitions, etc. over entire workouts, exercise name, total intervals, exercise types or exercise sets. The physical fitness grip tool 100 can also keep track of the type of exercises and the number of repetitions the user is performing through accelerometers and strain gauges. There are over 235 exercises and stretches with over a 1,000 different exercise combination that can be performed using the grips because there numerous ways one can combine specific lower and upper body exercises together. For example, there are many leg exercises that can be combined with over 20 types of self-resistance exercises. As such the grips incorporate major parts of the body, from the chest, triceps, back, biceps, forearms, shoulders, traps, abdominals and legs (e.g., quads, hamstrings, calves, hips, and glutes). The physical fitness grip tool 100 is also designed to incorporate a lower body exercise to be performed at the same time as an upper body exercise to increase workout productivity such as squats and shoulder exercises, or lunges and bicep exercises, sit-up and chest exercises, or walking and triceps exercises.

The user interacts with the fitness application 124 executed on the computing device via the GUI 110 to create a user profile. The user may then, through the user profile, interact with the fitness application 124 executed on the computing device via the GUI 110 to: select a workout category, select a workout within the workout category, view details of the workout, modify a parameter (e.g., a warm-up stretch, a cool-down stretch, an alternative exercise, a countdown timer, and/or a choice of movement, where the choice of movement includes sitting, standing, hiking, jogging, and/or running) within the selected workout, select an activity type for the workout (e.g., body weight resistance, self-resistance, band resistance, boxing, strap resistance, dumbbell, ab resistance, heavy jump rope, warm-up stretch, warm-up jogging drills, and/or cool-down stretch, among others), select a muscle group for the workout (e.g., chest, triceps, upper back, lower back, biceps, forearms, shoulders, traps, abs, obliques, quads, hamstrings, hips, and/or glutes, among others), select a difficulty level associated with the workout, view a workout history, view graphical depictions of the workout history, filter the workout history by date, filter the workout history by weight balance, and/or modify a grouping of workouts into a daily sequence unique to the user, among other actions.

The workouts are divided based on category, type of resistance, degree of difficulty, muscle group focus, and/or duration. The workout category may include a total body weight resistance workout, a self-resistance workout, a light dumbbells and boxing workout, a strap resistance workout, a band resistance workout, a heavy jump rope workout, and/or a just metrics workout, among others not explicitly listed herein. The total body weight resistance workout incorporates self-resistance, strap resistance, dumbbell, and mode of transportation exercises into the workout. The self-resistance workout uses connected grips to perform upper body self-resistance exercises, which entails using one body muscle group to partially resist another muscle group, typically performed during a specific range of motion. For the strap resistance workout, when secured to a suitable anchor, carabiners and straps attach to the grips to perform strap-resistance exercises, such as pull-ups. When the grips are disconnected, they can be secured to suitable fitness bands to perform band resistance exercises. Moreover, the disconnected grips can be secured to a rope attachment to perform heavy jump rope exercises. Further, when the user is not interested in following a pre-planned workout, but wants to use the grips to capture metrics, such as current force, maximum weight per repetition, total quantity of repetitions, Olympus weight, Olympus repetition weight, repetition weight average, total quantity of exercises, and/or total quantity of sets, the user may focus on a just metrics workout. It should be appreciated that the Olympus weight is a cumulative balance of a current force weight for every second of the workout.

Further, the details of the workout may include: an exercise name, an exercise order, a number of repetitions, a number of sets, a circuit identifier, an amount of rest, an estimated time for completion of each interval, a video demonstrating a number of intervals to perform a repetition, a textual explanation of how to perform the repetition, and/or a graphical explanation of how to perform the repetition, among others.

In an illustrative example, the user may keep track of the exercise metrics to motivate himself or herself to reach important milestones such as lifting the entire weight of a Polar Bear or Double Decker Bus over the course an entire workout. Users can compare this data to previous workouts and other users workouts, which can serve as motivation for further fitness improvement. This data can also be used to calculate more accurate calories burned data because it has access to a greater amount of data points.

It should be appreciated that the internal display 122 of the physical fitness grip tool 100 and the fitness application 124 executed on the computing device 116 may display varying information to the user, such as a current primary exercise associated with the current interval repetition count, a secondary exercise that may be performed simultaneously with the primary exercise, the set (or the number of complete exercise intervals for a specific exercise), the circuit (e.g., a group of exercises and their associated sets that are conducted in a specific sequence as a standalone group within a workout), an interval (a sum of the total number of sets completed for each exercise), a current force (the pounds or kilograms lifted, pushed or pulled per second), the last maximum repetition (e.g., the maximum force lifted over the last repetition), the average of the maximum force or pounds over the exercise, the time elapsed since the state of the workout, the trainer log, a number of calories burned, the Olympus weight (the cumulative balance of the current force weight for every second of the workout), the Olympus repetition weight (the cumulative balance of the last maximum repetition based on adding the results of every workout repetition), the repetition weight average (the average maximum repetition weight throughout the workout), a total number of repetitions, a weight class, a countdown timer, a rest period between each exercise interval, and/or a history section, among other information not explicitly listed herein.

The user will also have the opportunity to manually adjust any of this exercise information, as well as associated set numbers, through the internal display 122 of the physical fitness grip tool 100 and the fitness application 124 executed on the computing device 116. The user may be notified via the display 122 and/or the fitness application 124 executed on the computing device 116 on how to remedy performance of an exercise when the user is incorrectly performing one. Moreover, the fitness application 124 executed on the computing device 116 may also alert the user via audio, textual, or visual alert the title of the next exercise, the number of target repetitions, the number of calories burned, a time period during the exercise (e.g., the exercise is half completed), a beginning of a rest period, an end of the rest period, etc. Such serves as a training coach for the user.

Figure 28:
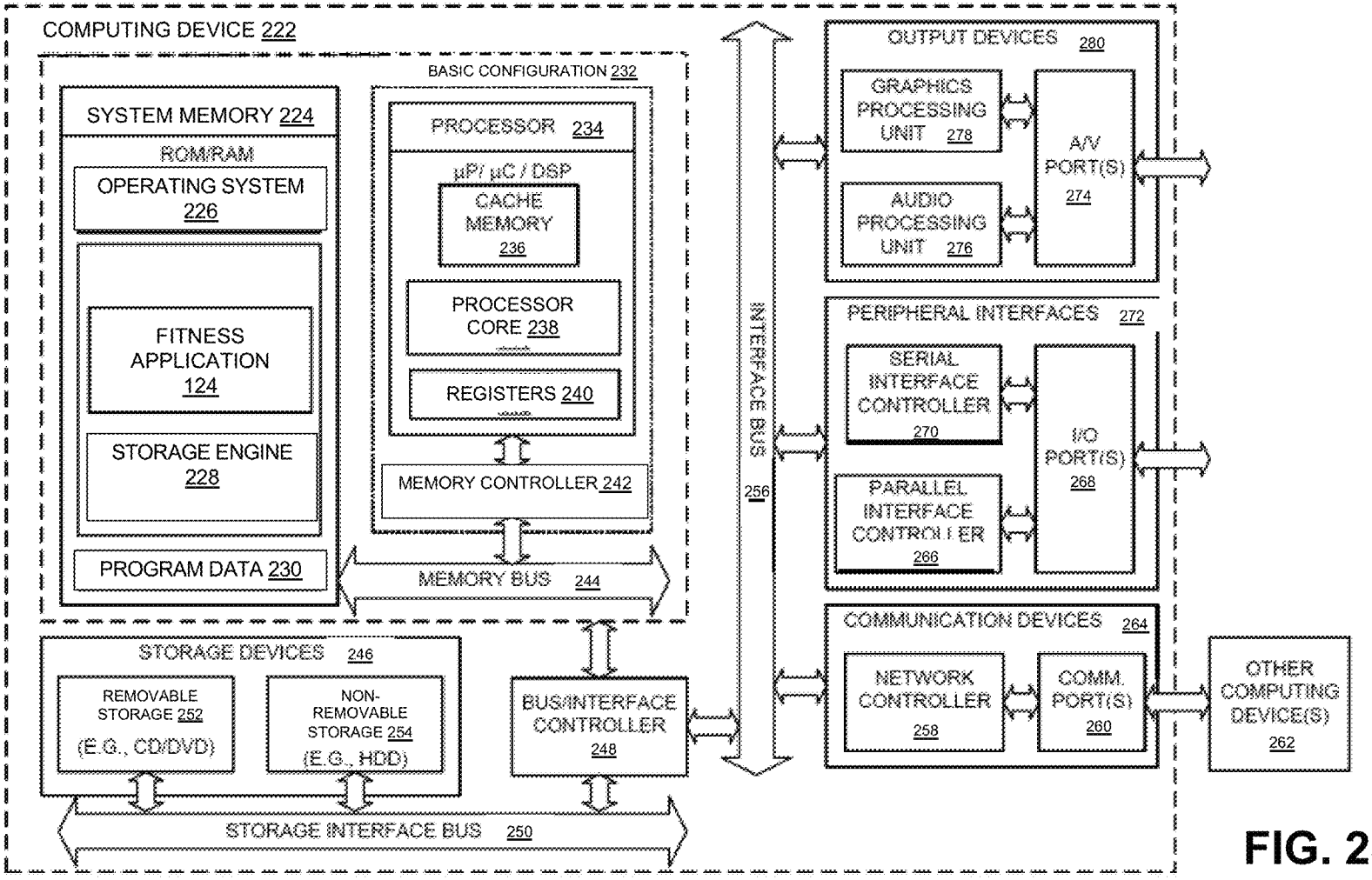
FIG. 28 depicts a block diagram of a computing device used within the physical fitness grip tool, according to at least some embodiments described herein.

FIG. 28 is a block diagram of the computing device included within the physical fitness grip tool 100. In some embodiments, the present invention may be a computer system, a method, and/or the computing device 222 (of FIG. 28). A basic configuration 232 of a computing device 222 is illustrated in FIG. 28 by those components within the inner dashed line. In the basic configuration 232 of the computing device 222, the computing device 222 includes a processor 234 and a system memory 224. In some examples, the computing device 222 may include one or more processors and the system memory 224. A memory bus 244 is used for communicating between the one or more processors 234 and the system memory 224.

Depending on the desired configuration, the processor 234 may be of any type, including, but not limited to, a microprocessor (μP), a microcontroller (μC), and a digital signal processor (DSP), or any combination thereof. Further, the processor 234 may include one more levels of caching, such as a level cache memory 236, a processor core 238, and registers 240, among other examples. The processor core 238 may include an arithmetic logic unit (ALU), a floating point unit (FPU), and/or a digital signal processing core (DSP Core), or any combination thereof. A memory controller 242 may be used with the processor 234, or, in some implementations, the memory controller 242 may be an internal part of the memory controller 242.

Depending on the desired configuration, the system memory 224 may be of any type, including, but not limited to, volatile memory (such as RAM), and/or non-volatile memory (such as ROM, flash memory, etc.), or any combination thereof. The system memory 224 includes an operating system 226, one or more engines, such as the fitness application 124, and program data 230. In some embodiments, the fitness application 124 may be an engine, a software program, a service, or a software platform, as described infra.

The computing device 222 may further include one or more strain gauges, as described herein, which may be any suitable sensor whose electrical resistance varies with applied force. In particular embodiments, the handle 114 interior has four strain gauges positioned at 90 degrees angles from each other, allowing processing device to determine the magnitude and direction of forces applied to the handle. The system memory 224 may also include a storage engine 228 that may store any information disclosed herein.

Moreover, the computing device 222 may have additional features or functionality, and additional interfaces to facilitate communications between the basic configuration 232 and any desired devices and interfaces. For example, a bus/interface controller 248 is used to facilitate communications between the basic configuration 232 and data storage devices 246 via a storage interface bus 250. The data storage devices 246 may be one or more removable storage devices 252, one or more non-removable storage devices 254, or a combination thereof. Examples of the one or more removable storage devices 252 and the one or more non-removable storage devices 254 include magnetic disk devices (such as flexible disk drives and hard-disk drives (HDD)), optical disk drives (such as compact disk (CD) drives or digital versatile disk (DVD) drives), solid state drives (SSD), and tape drives, among others.

In some embodiments, an interface bus 256 facilitates communication from various interface devices (e.g., one or more output devices 280, one or more peripheral interfaces 272, and one or more communication devices 264) to the basic configuration 232 via the bus/interface controller 256. Some of the one or more output devices 280 include a graphics processing unit 278 and an audio processing unit 276, which are configured to communicate to various external devices, such as a display or speakers, via one or more A/V ports 274.

The one or more peripheral interfaces 272 may include a serial interface controller 270 or a parallel interface controller 266, which are configured to communicate with external devices, such as input devices (e.g., a keyboard, a mouse, a pen, a voice input device, or a touch input device, etc.) or other peripheral devices (e.g., a printer or a scanner, etc.) via one or more I/O ports 268.

Further, the one or more communication devices 264 may include a network controller 258, which is arranged to facilitate communication with one or more other computing devices 262 over a network communication link via one or more communication ports 260. The one or more other computing devices 262 include servers, the database, mobile devices, and comparable devices.

The network communication link is an example of a communication media. The communication media are typically embodied by the computer-readable instructions, data structures, program modules, or other data in a modulated data signal, such as a carrier wave or other transport mechanism, and include any information delivery media. A "modulated data signal" is a signal that has one or more of its characteristics set or changed in such a manner as to encode information in the signal. By way of example, and not limitation, the communication media may include wired media (such as a wired network or direct-wired connection) and wireless media (such as acoustic, radio frequency (RF), microwave, infrared (IR), and other wireless media). The term "computer-readable media," as used herein, includes both storage media and communication media.

It should be appreciated that the system memory 224, the one or more removable storage devices 252, and the one or more non-removable storage devices 254 are examples of the computer-readable storage media. The computer-readable storage media is a tangible device that can retain and store instructions (e.g., program code) for use by an instruction execution device (e.g., the computing device 222). Any such, computer storage media is part of the computing device 222.

The computer readable storage media/medium can be a tangible device that can retain and store instructions for use by an instruction execution device. The computer readable storage media/medium may be, for example, but is not limited to, an electronic storage device, a magnetic storage device, an optical storage device, an electromagnetic storage device, and/or a semiconductor storage device, or any suitable combination of the foregoing. A non-exhaustive list of more specific examples of the computer readable storage media/medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, and/or a mechanically encoded device (such as punch-cards or raised structures in a groove having instructions recorded thereon), and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Aspects of the present invention are described herein regarding illustrations and/or block diagrams of methods, computer systems, and computing devices according to embodiments of the invention. It will be understood that each block in the block diagrams, and combinations of the blocks, can be implemented by the computer-readable instructions (e.g., the program code).

The computer-readable instructions are provided to the processor 234 of a general purpose computer, special purpose computer, or other programmable data processing apparatus (e.g., the computing device 222) to produce a machine, such that the instructions, which execute via the processor 234 of the computer or other programmable data processing apparatus, create means for implementing the functions/acts specified in the block diagram blocks. These computer-readable instructions are also stored in a computer-readable storage medium that can direct a computer, a programmable data processing apparatus, and/or other devices to function in a particular manner, such that the computer-readable storage medium having instructions stored therein comprises an article of manufacture including instructions, which implement aspects of the functions/acts specified in the block diagram blocks.

The computer-readable instructions (e.g., the program code) are also loaded onto a computer (e.g. the computing device 222), another programmable data processing apparatus, or another device to cause a series of operational steps to be performed on the computer, the other programmable apparatus, or the other device to produce a computer implemented process, such that the instructions, which execute on the computer, the other programmable apparatus, or the other device, implement the functions/acts specified in the block diagram blocks.

Computer readable program instructions described herein can also be downloaded to respective computing/processing devices from a computer readable storage medium or to an external computer or external storage device via a network (e.g., the Internet, a local area network, a wide area network, and/or a wireless network). The network may comprise copper transmission cables, optical transmission fibers, wireless transmission, routers, firewalls, switches, gateway computers, and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer/computing device, partly on the user's computer/computing device, as a stand-alone software package, partly on the user's computer/computing device and partly on a remote computer/computing device or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to block diagrams of methods, computer systems, and computing devices according to embodiments of the invention. It will be understood that each block and combinations of blocks in the diagrams, can be implemented by the computer readable program instructions.

The block diagrams in the Figures illustrate the architecture, functionality, and operation of possible implementations of computer systems, methods, and computing devices according to various embodiments of the present invention. In this regard, each block in the block diagrams may represent a module, a segment, or a portion of executable instructions for implementing the specified logical function (s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block and combinations of blocks can be implemented by special purpose hardware-based systems that perform the specified functions or acts or carry out combinations of special purpose hardware and computer instructions.

Another embodiment of the invention provides a method that performs the process steps on a subscription, advertising, and/or fee basis. That is, a service provider can offer to assist in the method steps described herein. In this case, the service provider can create, maintain, and/or support, etc. a computer infrastructure that performs the process steps for one or more customers. In return, the service provider can receive payment from the customer(s) under a subscription and/or fee agreement, and/or the service provider can receive payment from the sale of advertising content to one or more third parties.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

When introducing elements of the present disclosure or the embodiments thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A fitness tool comprising:

a grip component comprising:

a planar portion having a first side disposed opposite a second side;

the first side of the planar portion comprising:

a display; and a first attachment component configured to receive and affix a first attachment thereto;

a first component affixed to a first location on the first side of the planar portion and extending away from the first side of the planar portion;

a second component affixed to a second location on the first side of the planar portion and extending away from the first side of the planar portion, wherein the first location is disposed opposite the second location;

one or more buttons located on the planar portion and/or a handle component; and an electronics unit; and the handle component comprising one or more sensors, the handle component being disposed between the first component and the second component and being perpendicular to the first side of the planar portion of the grip component;

wherein the second side of the planar portion comprises a second attachment component configured to receive and affix a second attachment thereto;

wherein the second attachment is selected from the group consisting of: another grip, a weight, and a dumbbell.

2. The fitness tool of claim 1, wherein the first attachment comprises a smartphone.

3. The fitness tool of claim 1, wherein the planar portion of the grip component further comprises a receiving portion configured to receive a protruding portion of a second attachment therein, and wherein the second attachment further comprises a display.

4. The fitness tool of claim 1, wherein when a user executes a first button of the one or more buttons, a signal is transmitted to the electronics unit to count a number of repetitions.

5. The fitness tool of claim 1, wherein when a user executes a second button of the one or more buttons, a signal is transmitted to the electronics unit to progress to a next exercise.

6. The fitness tool of claim 1, wherein the one or more sensors are configured to:

measure a force applied to the handle component; and transmit the measurement of the force to the electronics unit.

7. The fitness tool of claim 1, wherein the electronics unit comprises:

a processor;

a memory; and a fitness application.

8. The fitness tool of claim 7, wherein the fitness application is configured to:

process and maintain data associated with exercise metrics of a user; and transmit the data associated with the exercise metric of the user to a computing device via WiFi, Bluetooth, or Bluetooth Low Energy.

9. A method of using the fitness tool of claim 1 to process and maintain data associated with exercise metrics of a user, the method comprising:

receiving, by a fitness application of the electronics unit, a signal from the one or more buttons to signal that the user is performing an exercise;

receiving, by the fitness application, a measurement of force applied to the handle component from the one or more sensors;

processing, by the fitness application, the signal and the measurement of force; and transmitting, by the fitness application, the signal, the measurement of force, and other exercise metrics to a computing device.

10. The method of claim 9, wherein the computing device comprises:

a processor;

a memory coupled to the processor;

a graphical user interface (GUI); and the fitness application.

11. The method of claim 10, wherein a user is configured to interact with the fitness application via the GUI to create a user profile, select a workout category, select a workout within the workout category, view details of the workout, modify a parameter within the selected workout, select an activity type for the workout, select a muscle group for the workout, select a difficulty level associated with the workout, view a workout history, view graphical depictions of the workout history, filter the workout history by date, filter the workout history by weight balance, and/or modify a grouping of workouts into a daily sequence unique to the user.

12. The method of claim 11, wherein the workouts are divided based on category, degree of difficulty, muscle group focus, and/or duration.

13. The method of claim 11, wherein the parameter is selected from the group consisting of: a warm-up stretch, a cool-down stretch, an alternative exercise, a countdown timer, and a choice of movement.

14. The method of claim 13, wherein the choice of movement is selected from the group consisting of: sitting, standing, hiking, jogging, and running.

15. The method of claim 11, wherein the details of the workout are selected from the group consisting of: an exercise name, an exercise order, a number of repetitions, a rest time, a number of sets, a circuit identifier, an estimated time for completion of each interval, a video demonstrating how to perform a repetition, a textual explanation of how to perform the repetition, and a graphical explanation of how to perform the repetition.

16. The method of claim 11, wherein the muscle group is selected from the group consisting of: chest, triceps, upper back, lower back, biceps, forearms, shoulders, traps, abs, obliques, quads, hamstrings, hips, and glutes.

17. The method of claim 11, wherein the activity type is selected from the group consisting of: body weight resistance, self-resistance, strap resistance, dumbbell, band resistance, boxing, heavy jump rope, warm-up stretch, warm-up jogging drills, and cool-down stretch.

18. The method of claim 9, wherein the fitness application transmits the signal, the measurement of force, and the either exercise metrics to the computing device via WiFi, Bluetooth, or Bluetooth Low Energy.

19. A fitness tool comprising:

a grip component comprising:

a planar portion having a first side disposed opposite a second side;

the first side of the planar portion comprising:

a display; and a first attachment component configured to receive and affix a first attachment thereto;

a first component affixed to a first location on the first side of the planar portion and extending away from the first side of the planar portion;

a second component affixed to a second location on the first side of the planar portion and extending away from the first side of the planar portion, wherein the first location is disposed opposite the second location;

one or more buttons located on the planar portion and/or a handle component; and an electronics unit; and the handle component comprising one or more sensors, the handle component being disposed between the first component and the second component and being perpendicular to the first side of the planar portion of the grip component;

wherein the first attachment comprises a smartphone.

20. A fitness tool comprising:

a grip component comprising:

a planar portion having a first side disposed opposite a second side;

the first side of the planar portion comprising:

a display; and a first attachment component configured to receive and affix a first attachment thereto;

a first component affixed to a first location on the first side of the planar portion and extending away from the first side of the planar portion;

a second component affixed to a second location on the first side of the planar portion and extending away from the first side of the planar portion, wherein the first location is disposed opposite the second location;

one or more buttons located on the planar portion and/or a handle component; and an electronics unit; and the handle component comprising one or more sensors, the handle component being disposed between the first component and the second component and being perpendicular to the first side of the planar portion of the grip component;

wherein the planar portion of the grip component further comprises a receiving portion configured to receive a protruding portion of a second attachment therein, and wherein the second attachment further comprises a display.

* * * * *